US006076475A

United States Patent [19]

Kuhn et al.

[11] Patent Number: 6,076,475

[45] Date of Patent: Jun. 20, 2000

[54] DIVISIBLE SHIPPING PLATFORM APPARATUS

[75] Inventors: Wayne Kuhn, Palos Park; Robert Miller, Yorkville; Elizabeth G. Wilson, Wheaton, all of Ill.

[73] Assignee: Stone Container Corporation, Chicago, Ill.

[21] Appl. No.: 09/187,512

[22] Filed: Nov. 6, 1998

Related U.S. Application Data

[63] Continuation-in-part of application No. 08/778,496, Jan. 3, 1997, Pat. No. 5,832,841, which is a continuation of application No. 08/326,544, Oct. 20, 1994, Pat. No. 5,590,606, which is a continuation of application No. 07/876,572, Apr. 30, 1992, Pat. No. 5,388,531, which is a continuation of application No. 07/634,426, Dec. 27, 1990, abandoned.

[51] Int. Cl.[7] ..... B65D 19/22

[52] U.S. Cl. ..... 108/51.3

[58] Field of Search ..... 108/51.3, 51.11, 108/54.1, 157.14; 109/563

[56] References Cited

U.S. PATENT DOCUMENTS

| | | |
|---|---|---|
| 2,503,240 | 4/1950 | Cahners . |
| 2,583,443 | 1/1952 | Perry et al. . |
| 2,631,724 | 3/1953 | Wright . |
| 2,691,500 | 10/1954 | Baumann . |
| 2,888,221 | 5/1959 | Connelly . |
| 2,914,282 | 11/1959 | Budd . |

(List continued on next page.)

FOREIGN PATENT DOCUMENTS

| | | |
|---|---|---|
| 603977 | 3/1990 | Australia . |
| 569513 | 11/1954 | Canada . |
| 2466402 | 4/1981 | France . |
| 2569659 | 3/1986 | France . |
| 2588832 | 4/1987 | France . |
| 2676994 | 12/1992 | France . |
| 7211803 | 3/1972 | Germany . |
| 2520443 | 11/1975 | Germany . |
| 4535610 | 11/1970 | Japan . |
| 5037266 | 8/1973 | Japan . |
| 2324947 | 2/1990 | Japan . |
| 697232 | 4/1950 | United Kingdom . |
| 779020 | 12/1954 | United Kingdom . |
| 2127773 | 4/1984 | United Kingdom . |
| 2165520 | 9/1984 | United Kingdom . |

OTHER PUBLICATIONS

Promotional two page brochure describing Stone Container Corporation's paperboard sold under the trademark "COR-DECK", Approx. 1985–1986.

(List continued on next page.)

*Primary Examiner*—Jose V. Chen
*Attorney, Agent, or Firm*—Dick & Harris

[57] ABSTRACT

A divisible shipping platform apparatus for supporting and transporting loads, in which the apparatus is easily divided into multiple independent shipping platform units for subsequent transporting and handling loads. The divisible shipping platform apparatus comprises a platform member separated from a bottom panel member by a series of pylons. The platform member and bottom panel member are constructed with one or more frangibility lines dividing the platform member and bottom panel member into divisible regions. Inasmuch as those frangibility lines and divisible regions are substantially aligned, independent shipping platform units may be separated from the divisible shipping platform apparatus upon exertion of a force on the divisible regions and, in turn, the frangibility lines. Pylon sleeves, substantially corresponding to the configuration of the platform member and bottom panel member divisible regions, may be associated with the pylons to facilitate division of the divisible shipping platform apparatus and to provide increased structural integrity for the independent shipping platform units. The divisible shipping platform may also be constructed with multiple, independent bottom panels corresponding to each platform member divisible region, or no bottom panel at all. Likewise, the divisible shipping platform may be constructed of a substantially unitary paperboard blank.

51 Claims, 8 Drawing Sheets

U.S. PATENT DOCUMENTS

| | | | |
|---|---|---|---|
| 2,925,978 | 2/1960 | Marso . | |
| 2,953,339 | 9/1960 | Roshon . | |
| 2,997,266 | 8/1961 | Munroe . | |
| 3,026,078 | 3/1962 | Simkins . | |
| 3,266,444 | 8/1966 | Budd . | |
| 3,398,703 | 8/1968 | Mezzano . | |
| 3,407,758 | 10/1968 | Simkins . | |
| 3,425,367 | 2/1969 | Oravez . | |
| 3,464,371 | 9/1969 | Gifford . | |
| 3,605,651 | 9/1971 | Stewart . | |
| 3,650,224 | 3/1972 | Petix et al. | 108/54.1 |
| 3,685,463 | 8/1972 | Francis . | |
| 4,062,301 | 12/1977 | Pitchford | 108/54.1 X |
| 4,095,769 | 6/1978 | Fengels | 108/54.1 X |
| 4,228,744 | 10/1980 | Moore . | |
| 4,244,766 | 1/1981 | Yellen . | |
| 4,487,136 | 12/1984 | Beckway . | |
| 4,694,962 | 9/1987 | Taub | 108/54.1 X |
| 4,850,284 | 7/1989 | DeGroot et al. . | |
| 4,875,419 | 10/1989 | Helton et al. . | |
| 5,105,746 | 4/1992 | Reynolds | 108/54.1 X |
| 5,267,516 | 12/1993 | Abrahamson et al. | 108/54.1 |
| 5,370,064 | 12/1994 | Sgabellone | 108/157.14 X |
| 5,388,531 | 2/1995 | Crews et al. . | |
| 5,546,871 | 8/1996 | Chapman | 108/54.1 |
| 5,590,606 | 1/1997 | Crews et al. . | |
| 5,832,841 | 11/1998 | Crews et al. . | |

OTHER PUBLICATIONS

Six page Berkshire Disposable Pallet brochure with one page Feb. 14, 1969 transmittal letter.

Four page Spur Pallets brochure (est. 1969) by Wilcox & Gibbs, Inc.

Modern Material Handling (est. 1969–1970) p. 99 advertisement for Shipmate brand pallets with honeycomb legs of Union Camp.

Handling & Shipping, Mar., 1970, p. 93 product disclosure for Union Camp honeycomb runners for boxes.

Unknown trade journal, Oct. 1970, p. 76, 79 article entitled "Honeycomb Goes Outside" describing Union Camp's honeycomb–leg product.

Union Camp four page brochure entitled "Shipmate Pallet Runners" (est. 1970's).

Fig 7
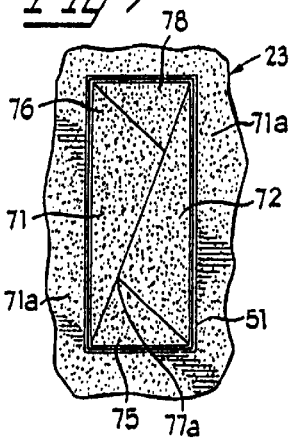
Fig 8
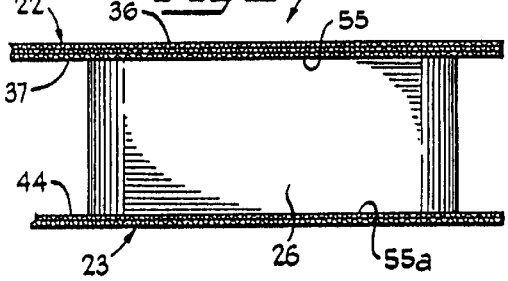
Fig 18
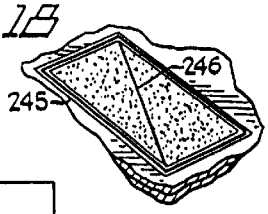
Fig 19
Fig 16
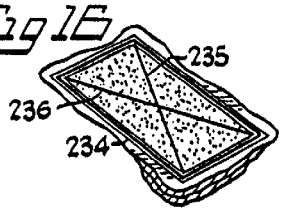
Fig 9
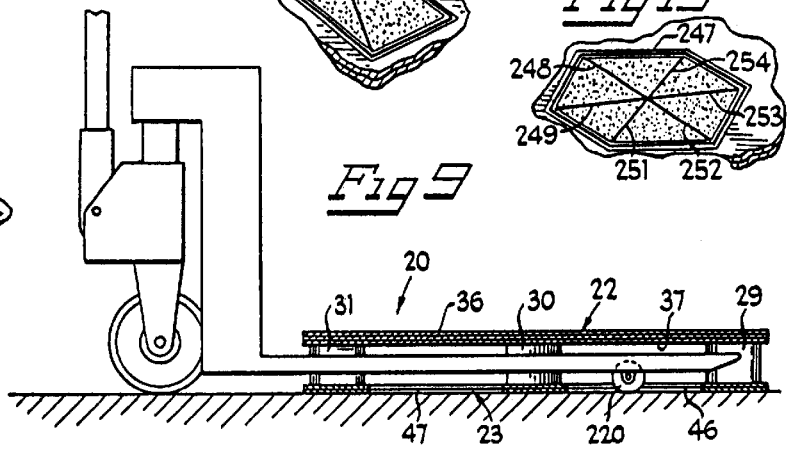
Fig 17
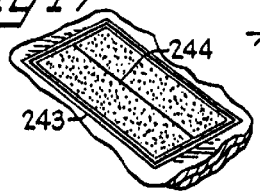
Fig 10
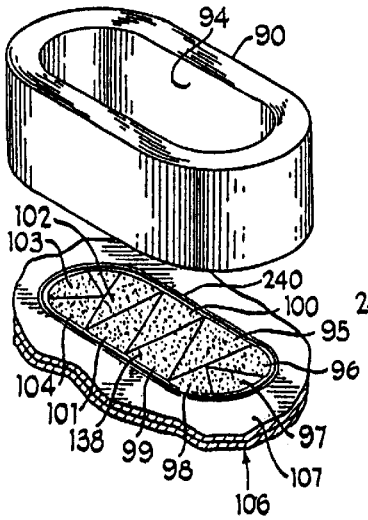
Fig 11
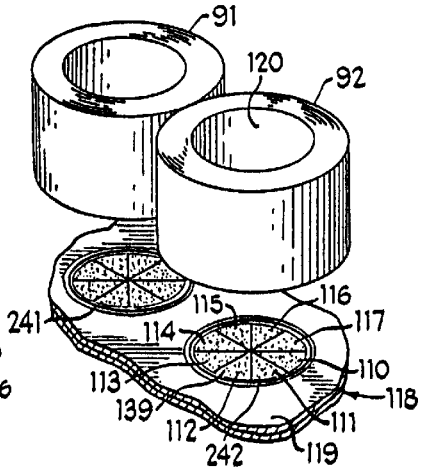
Fig 12
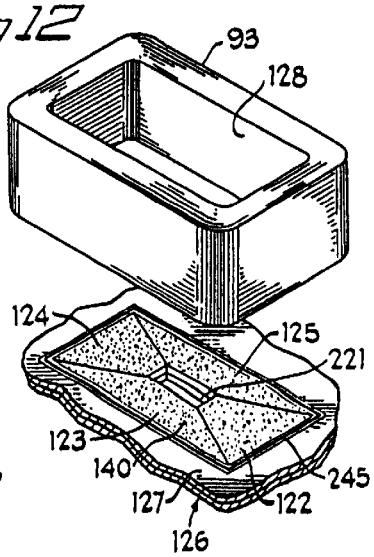

460

DIVISIBLE SHIPPING PLATFORM APPARATUS

The present application is a continuation-in-part application of Ser. No. 08/778,496, filed on Jan. 3, 1997, now U.S. Pat. No. 5,832,841 which is a continuation of Ser. No. 08/326,544, filed Oct. 20, 1994, now U.S. Pat. No. 5,590,606, which is a continuation of Ser. No. 07/876,572, filed Apr. 30, 1992, now U.S. Pat. No. 5,388,531, which is a continuation of Ser. No. 07/634,426, filed Dec. 27, 1990, now abandoned.

BACKGROUND OF THE INVENTION

1. Field of the Invention

The present invention relates in general to shipping platforms, and, more particularly, to a divisible shipping platform for supporting and transporting loads by conventional tined material handling equipment both before and after division into smaller, independent shipping platform units.

2. Background Art

For many years, industry has utilized shipping platforms for purposes of storing, handling and transporting a vast array of materials. While many of such platforms comprise pallets formed of wood, more recently several such shipping platforms have been constructed out of substantially recyclable fibrous material such as paperboard. These prior art paperboard shipping platforms have typically consisted of a top deck, a bottom deck, and pylons positioned therebetween. Such a construction allows cooperation with conventional tined material handling equipment, such as a fork lift, yet still provides the strength necessary to handle and transport heavy and sizeable loads.

Although relatively light in weight, these shipping platforms are quite burdensome with respect to their overall size. Accordingly, certain "end use" issues such as disposability and storage capability—these products cannot just simply be placed in a conventional paper compactor or other disposal container—have arisen. Indeed, to facilitate disposal in such bins or containers, without, for all practical purposes, causing the shipping platform to exceed the size limits of the compactor, or to occupy a substantial portion of the bin or container, an individual would have to exert a great deal of effort in physically dismantling and then crushing the apparatus or, in the alternative, placing the apparatus in an industrial size trash compactor not readily available to some users of such shipping platforms. Likewise, the overall size of these shipping platforms makes storage of such shipping platforms exceedingly space consuming and cost-ineffective.

Crews et al., U.S. Pat. No. 5,388,531, has addressed the disposability of substantially recyclable shipping platforms. In particular, Crews et al. '531 teaches the use of frangibility lines in both the upper and lower pallet decks to facilitate reduction of the overall size of the shipping platform after use, to, in turn, facilitate disposal of the platform in a conventional trash bin or compactor. Specifically, one of the pallet decks may be completely severed along a frangibility line, while the other deck may be weakened along a corresponding frangibility line. The severed deck portion is then folded over the weakened portion of the opposite deck, thus reducing the overall size of the shipping platform for disposal.

Through such frangibility the platforms further enable the reduction of loads into smaller loads at a receiving site, storing of the smaller broken-down loads, and subsequent handling and transportation of the smaller loads. In particular, it is sometimes cost effective and/or efficient to ship materials in larger loads to a distributor or wholesaler—for instance, a warehouse or distribution center—where such materials from the warehouse or distribution center can subsequently be reduced in size without depalletizing in smaller quantities.

Accordingly, it is an object of the present invention to provide a shipping platform apparatus which is divisible into smaller, independent shipping platform units, wherein such division is easily accomplished with little time or effort, to accordingly facilitate subsequent use of the smaller independent shipping platform units for supporting, storing, handling and a transporting smaller broken down loads.

It is further an object of the present invention to provide a shipping platform apparatus for two-way or four-way entry into both the initial shipping platform, and the smaller, independent platform units, by conventional material handling devices.

It is yet another object of the present invention to provide a divisible shipping platform which is constructed of a substantially recyclable and/or biodegradable material which can be disposed after use, so as to reduce further damage to the ecology typically caused by non-biodegradable and/or non-recyclable material, while simultaneously conserving natural resources.

At the same time, it is an object to provide a low-cost, lightweight, divisible shipping platform which can be fabricated in a facilitated manner by automatic formation equipment.

It is still further an object of the present invention to provide a shipping platform apparatus which is configured to have relatively strong shear strength, without protruding fasteners, thereby enabling an increased load to be supported thereon.

These and other objects of the present invention will become apparent in light of the present specification and drawings.

SUMMARY OF THE INVENTION

The present invention comprises a divisible shipping platform apparatus for supporting and transporting loads by conventional tined material handling devices, which divisible shipping platform is separable into multiple independent shipping platform units for subsequently handling, supporting, and transporting loads by conventional tined material handling devices. The divisible shipping platform comprises a load-bearing platform member which is used for supporting the load, a bottom panel member distally spaced and positioned parallel to and below the platform member, and a plurality of pylons operably positioned between the platform member and the bottom panel member so as to facilitate the insertion, maintenance and removal of the tines of the conventional tined material handling devices therebetween.

The platform member has a top surface, a bottom surface opposite the top surface, and at least one frangibility line substantially spanning the width or length thereof. In a preferred embodiment, the platform member includes both longitudinal and transverse frangibility lines, thus dividing the platform member into divisible regions. The frangibility lines may comprise perforations, score lines, or a tear strip, and allow the platform member to be completely severed. Preferably, the frangibility lines comprise perforations with a predetermined configuration and length, which define a top panel member frangibility threshold.

The bottom panel member likewise has a top surface, a bottom surface, and at least one frangibility line. The bottom panel member supports and bears the weight of both the platform member and the load. In a preferred embodiment, the bottom panel member includes both longitudinal and transverse frangibility lines substantially aligned with the platform member frangibility lines, thus dividing the bottom panel member into divisible regions substantially corresponding to the platform member divisible regions. The bottom panel member frangibility lines also have a predetermined configuration and size, defining a bottom panel member frangibility threshold.

In a preferred embodiment, the bottom panel member frangibility lines differ in at least one of configuration and length from the platform member frangibility lines to impart a different frangibility threshold on the bottom panel member. Indeed, the bottom panel member preferably has a lower frangibility threshold to facilitate division of the divisible shipping platform.

In yet another preferred embodiment, the platform member frangibility lines are at least partially misaligned from the bottom panel member frangibility lines to prevent inadvertent and/or premature separation of the divisible shipping platform into multiple components.

Also in a preferred embodiment, apertures are positioned in the bottom panel member. These apertures enable effective cooperation of the divisible shipping platform apparatus with conventional material handling devices which utilize fork tines for insertion between the platform member and the bottom panel member, for purposes of raising, relocating and/or lowering the divisible shipping platform apparatus, and accordingly the load as well. With such handling devices, wheel or weight bearing projections may emanate through the apertures as a load on the divisible shipping platform is raised. The apertures are preferably formed in each bottom panel member divisible region so as to allow effective cooperation with conventional tined material handling devices both before division of the divisible shipping platform and after division into independent shipping platform units.

In another preferred embodiment of the invention, the apertures may be replaced by perforated disks which remain in the bottom panel means for increased rigidity until "popped-out" by, for example, penetration by a supporting member of a jack-type material handling device.

The pylons are operably positioned between the platform member and the bottom panel member so as to facilitate the insertion, maintenance and removal of the tines of the conventional tined material handling devices therebetween. In addition, the pylons further maximize the supportable strength of the divisible shipping platform apparatus while providing balance, stability and support to the divisible shipping platform apparatus during use thereof. Each of the pylons has a top end, a bottom end, and an outer surface. In a preferred embodiment, the pylons are substantially elongated, constructed from multiple layers of paperboard material and span the length of the platform and bottom panel divisible regions. In another preferred embodiment, the pylons are hollow with an interior surface. In yet another preferred embodiment, the pylons are placed at the four corners of each divisible region so as to allow for tine insertion on each side of both the divisible shipping platform and the independent shipping platform units. The pylon shapes may comprise any desirable shape, including square, rectangular, circular, oval, triangular, pentagonal, hexagonal, etc., or combinations thereof.

The top ends of the pylons are secured to the bottom surface of the platform member, and the bottom ends of the pylons are secured to the top surface of the bottom panel member. An adhesive or other securing element is used for operably securing the top end of the pylons to the bottom surface of the platform member, as well as for securing the bottom end of the pylons to the top surface of the bottom panel member.

Once fully articulated, a force, such as the upward movement of a forklift tine, easily severs the divisible shipping platform apparatus. In particular, a force applied to the bottom surface of a platform member divisible region severs the platform member along the divisible region frangibility lines. The force, in turn, is exerted on the bottom panel member through the pylon connection, likewise severing the bottom panel divisible region, and thus forming an independent shipping platform unit. In a preferred embodiment, the bottom panel divisible region frangibility threshold is lower than that of the corresponding platform member divisible regions to facilitate division of the divisible shipping platform apparatus.

In another preferred embodiment, the divisible shipping platform apparatus further comprises a pylon sleeve for operably housing the pylons. The pylon sleeve includes a top sleeve member, having a top surface, a bottom surface, a first side edge, a second side edge, a first top sleeve member side panel, and a second top sleeve member side panel; and a bottom sleeve member, likewise having a top surface, a bottom surface, a first side edge, a second side edge, a first bottom sleeve member side panel, a second bottom sleeve member side panel. The bottom sleeve member further includes an aperture substantially corresponding in size and shape to the apertures in the bottom panel member.

To use the pylon sleeve in conjunction with the divisible shipping platform, the pylons are secured in the pylon sleeve, which is, in turn, secured between a divisible region of the platform member and a corresponding divisible region of the bottom panel member. Of course, pylon sleeves and associated pylons are positioned between each platform member divisible region and its corresponding bottom panel member divisible region. In a preferred embodiment, the pylon sleeves have a shape and size substantially corresponding to the shape and size of each divisible region. The pylon sleeves provide a greater surface area of contact between the pylons and the platform member and the bottom panel member—thus more securely integrating the platform member with the bottom panel member to facilitate division of the divisible shipping platform. Moreover, the pylon sleeves also add strength and structural integrity to the severed independent shipping platform units. Of course, it is also contemplated that the pylon sleeve may be used in association with the platform member and pylons—without the bottom panel member.

In yet another preferred embodiment, the pylon sleeves are modified such that they each house four pylons, positioned at each corner thereof. Such a configuration creates tine insertion gaps in each of the four sides of the divisible shipping platform, and in each of the four sides of the severed independent shipping platform units.

In still another preferred embodiment, the divisible shipping platform comprises a platform member, pylons, and a plurality of bottom panels. Instead of a single divisible bottom panel member, each divisible region of the platform member is substantially aligned with and attached through pylon connection to a separate bottom panel. Accordingly, only the top panel needs to be severed in order to separate the divisible shipping platform into independent shipping platform units.

In another preferred embodiment, the divisible shipping platform apparatus comprises a platform member and pylons—without a divisible bottom panel member or separate bottom panel members. The pylons rest on the shipping platform support surface, and the platform member may be divided along its frangibility lines into independent shipping platform units in much the same way as described above in reference to the other embodiments.

In yet another preferred embodiment, the divisible shipping platform apparatus is constructed from a substantially unitary paperboard blank comprising a top panel, a first side panel, a second side panel, a first bottom wing panel, and a second bottom wing panel. The top panel includes at least one frangibility line, or in a preferred embodiment, both longitudinal and transverse frangibility lines. Likewise, also in a preferred embodiment, the first side panel, second side panel, first bottom wing panel, and second bottom wing panel also include frangibility lines substantially aligned with the top panel transverse frangibility line.

In another preferred embodiment, the first and second side panels include openings to allow for insertion and removal of tines from conventional material handling devices into and from all four sides of the divisible shipping platform. Likewise, the first bottom wing panel and second bottom wing panel may each have at least one aperture for cooperation with material handling devices.

In a preferred embodiment of the invention, the platform member, the bottom panel member, as well as the pylon means are each constructed from at least one layer of substantially biodegradable corrugated paperboard material, although other paper materials are also contemplated.

In selected embodiments, the platform member comprises three layers of substantially biodegradable corrugated paperboard material, in which the corrugation of each layer of the corrugated paperboard are positioned in relative uniform parallel alignment with one another. The bottom panel member comprises two layers of a substantially biodegradable corrugated paperboard material, in which the corrugation of each layer of the corrugated paperboard are positioned in relative uniform parallel alignment with one another. The relatively uniform parallel alignment of the corrugations of the three layers of the corrugated paperboard material of the platform member may be positioned above and transverse to the relatively uniform parallel alignment of the corrugations of the two layers of corrugated paper material of the bottom panel member, so as to impart increased unidirectional strength to the divisible shipping platform apparatus in both the longitudinal and transverse directions. Alternatively, the corrugations in the platform member and bottom panel member may be parallel to increase the beam strength of the divisible shipping platform apparatus.

In still another embodiment of the invention, the pylons and/or the bottom panel member may be constructed from a substantially plastic or wood material.

In another embodiment of the invention, the platform member and the bottom panel member are coated with a substantially moisture impervious material. Other coating materials may be used, such as coatings which are substantially fire resistant, and/or coatings which are substantially insect resistant.

BRIEF DESCRIPTION OF THE DRAWINGS

FIG. 7 of the drawings is an enlarged top plan view of one of the articulateable flap means shown in FIG. 1, showing in particular, the fold lines surrounding the flaps themselves, which substantially correspond to the interior region of the pylon means it will secure, as well as the height maximizing configuration of the flaps themselves;

FIG. 8 of the drawings is an is an elevated side view of a portion of the shipping platform apparatus as shown in FIG. 1, showing in particular, the positioning of one of the pylon means between the platform means and the bottom panel means;

FIG. 9 of the drawings is a partial cross-sectional side view of the shipping platform apparatus, showing in particular, the cooperation of a conventional material handling fork tine positioned between the platform means and bottom panel means and adjacent the pylon means, and more specifically the location of a load-supporting wheel of the fork tine positioned in the aperture means of the bottom panel means;

FIG. 10 of the drawings is an exploded perspective view of a substantially oval shaped pylon means, along with the configuration of the respective articulateable flap means used to secure the pylon means to the bottom panel means and showing, in particular, the fold line configuration of the articulateable flap means which substantially conforms to the configuration of the interior region of the oval pylon means;

FIG. 11 of the drawings is an exploded perspective view of two substantially cylindrically shaped pylon means in abutment with each other, along with the star-burst patterns of the respective articulateable flap means used to secure the pylon means to the bottom panel means, showing in particular the fold line configurations of the articulateable flap means which each substantially conforms to the configurations of the interior regions of each of the cylindrically shaped pylon means;

FIG. 12 of the drawings is an exploded perspective view of a substantially rectangular shaped pylon means, along with the configuration of the respective articulateable flap means used to secure the pylon means to the bottom panel means, particularly showing the fold line configuration of the articulateable flap means which substantially conforms to the configuration of the interior region of the rectangular pylon means;

FIG. 16 of the drawings is a perspective view of one type of articulateable flap means, showing in particular, the fold lines surrounding the flaps themselves, which substantially correspond to the interior region of the pylon means it will secure, as well as the height and width-maximizing configuration of the flaps themselves;

FIG. 17 of the drawings is a perspective view of one type of articulateable flap means, showing in particular, the fold lines surrounding the flaps themselves, which substantially correspond to the interior region of the pylon means it will secure, as well as the width-maximizing configuration of the flaps themselves;

FIG. 18 of the drawings is a perspective view of one type of articulateable flap means, showing in particular, the fold lines surrounding the flaps themselves, which substantially correspond to the interior region of the pylon means it will secure, as well as the height-maximizing configuration of the flaps themselves; and, FIG. 19 of the drawings is a perspective view of one type of articulateable flap means, showing in particular, the fold lines surrounding the flaps themselves, which substantially correspond to the interior region of the pylon means it will secure, as well as the width and height-maximizing configuration of the flaps themselves.

DETAILED DESCRIPTION OF THE DRAWINGS

Figure 1:
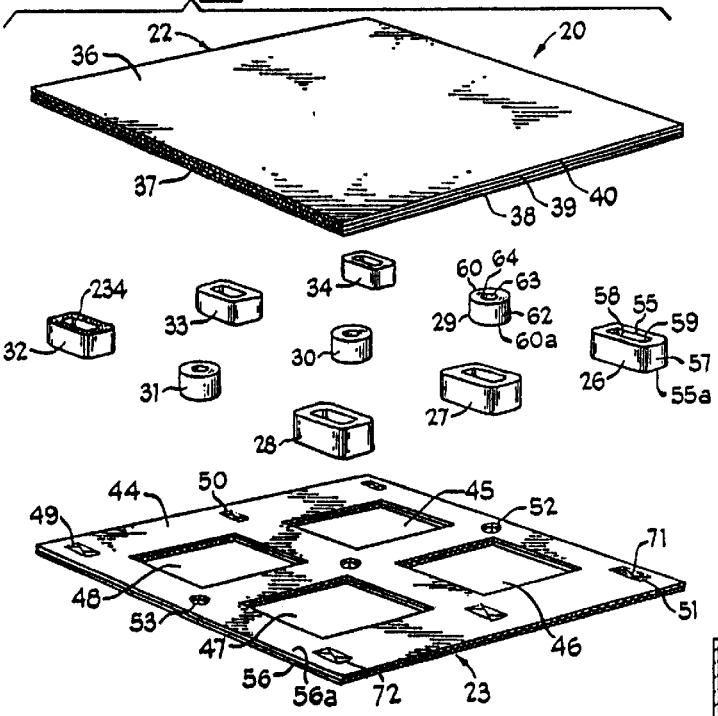
FIG. 1 of the drawings is an exploded perspective view of the present shipping platform apparatus showing, in particular, the platform means, the bottom panel means, and the pylon means which are positioned therebetween.

While this invention is susceptible of embodiment in many different forms, there is shown in the drawings and will herein be described in detail, several specific embodiments with the understanding that the present disclosure is to be considered as an exemplification of the principles of the invention and is not intended to limit the invention to the embodiments illustrated.

Shipping platform apparatus 20 is shown in FIG. 1 as including platform means 22, bottom panel means 23, and pylon means 26 through 34 which separate platform means 22 from bottom panel means 23. Platform means 22 comprises top load bearing surface 36 and bottom surface 37, and is preferably constructed of three paperboard corrugated layers 38, 39 and 40, although other paper materials and numbers of layers are also contemplated. Bottom panel means 23 comprises top surface 44, a bottom surface (not shown), and aperture means 45, 46, 47 and 48. Although each of these apertures are shown to have substantially rectangular shaped openings, other configurations as well as other sizes, can also be utilized. Bottom panel means 23 further includes articulateable flap means, such as articulateable flap means 49, 50, 51, 52 and 53, which are used to secure each respective pylon means, such as pylon means 32, 26, 29 and 31, to bottom panel means 23. Ideally, as will be explained in greater detail in FIGS. 10, 11 and 12, each of the articulateable flap means are configured to have fold lines, such as fold line 72, which substantially conform to the particular shape of the interior region, such as interior region 58, of the respective pylon means 26 through 34, for facilitating secured attachment therebetween. In addition, it is also preferred that bottom panel means 23, be constructed of two corrugated paperboard layers, 56 and 56*a,* although, like platform means 22, other paper materials, as well as numbers of layers, are also contemplated.

As shown in FIG. 1, preferably the corrugations of platform means 22 are all parallel in sheets 38 through 40, which run transverse to the corrugations of sheets 56 and 56*a* in bottom panel 23.

Pylon means 26 through 34, which are used not only to separate platform means 22 from bottom panel means 23, but are also used as structural supports when a load is actually placed upon platform means 22, each comprise a top end, such as top ends 55 and 60, a bottom end, such as bottom ends 55*a* and 60*a*, an outer surface, such as outer surfaces 57 and 62, an interior region, such as interior regions 58 and 63, as well as an inner surface, or interior wall, such as interior walls 59 and 64.

When shipping platform apparatus 20 is fully assembled, bottom side 37 of platform means 22, will abut with top ends, such as top ends 55 and 60, of the pylon means, such as pylon means 26 and 29, respectively, and bottom ends, such as bottom ends 55*a* and 60*a*, of each of the pylon means, such as pylon means 26 and 29, respectively, will abut in operable attachment with top surface 44 of bottom panel means 23. Furthermore, as will be shown in greater detail, each of the pylon means 26 through 34, will be positioned over articulateable flap means, such as articulateable flap means 49 through 53, so that the flaps themselves will be exposed to the respective interior region of a pylon, such as interior region 58 and 63, of each of the pylon means. It is preferred that shipping platform apparatus 20 be constructed of a substantially recyclable paper material such as corrugated paperboard-inasmuch as one of the objectives of the invention is to conserve natural resources and reduce further damage to the ecosystem. Also shown in FIG. 1 is adhesive means, such as adhesive means 71, as applied to articulateable flap means for attachment with pylon means, such as pylon means 26, and adhesive means 234 as applied to the top end of pylon means, such as pylon means 32, for attachment to bottom surface 37 of platform means 22.

Figure 3:
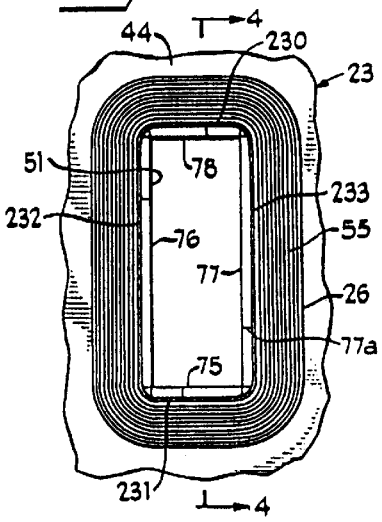
FIG. 3 of the drawings is an enlarged top view of one of the pylon means as attached to the bottom panel means by the articulateable flap means, and, showing in particular, the adhesive used to secure each of the flaps to the interior wall of the respective pylon means.
Figure 4:
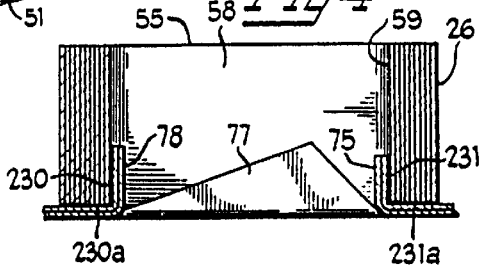
FIG. 4 of the drawings is an elevated partial cross-sectional side view of one of the pylon means shown in FIG. 3, taken along lines 4—4 and looking in the direction of the arrows, as attached to the bottom panel means by the articulateable flap means, showing, in particular, the operable positioning and maximized height of contact of the individual flaps as attached to the interior surface of the respective pylon means.
Figure 2:
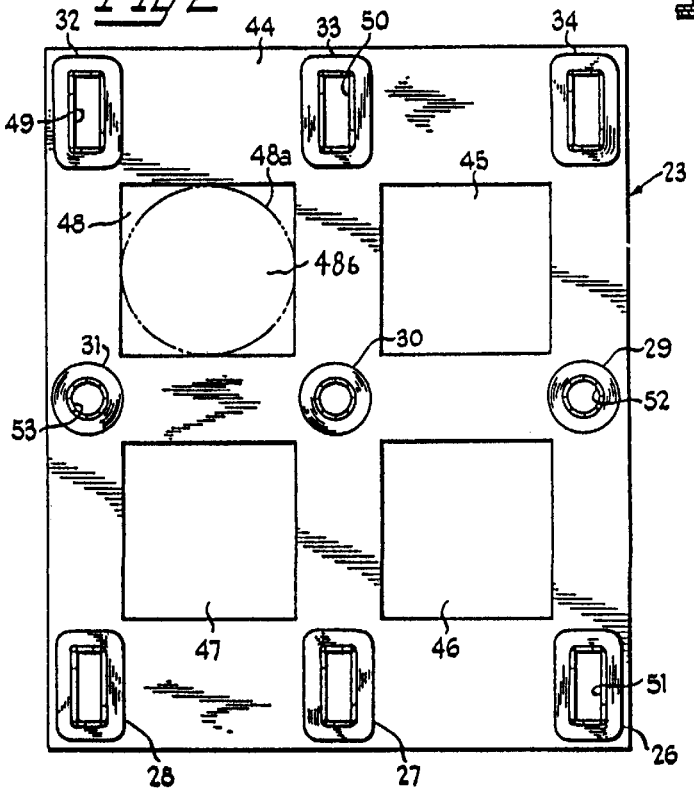
FIG. 2 of the drawings is a top plan view of the bottom panel means, and the pylon means, prior to attachment of the platform means thereon, showing in particular, the articulateable flap means securing each of the pylon means to the bottom panel means, as well as showing the rectangular shaped aperture means of the bottom panel means.
Figure 5:
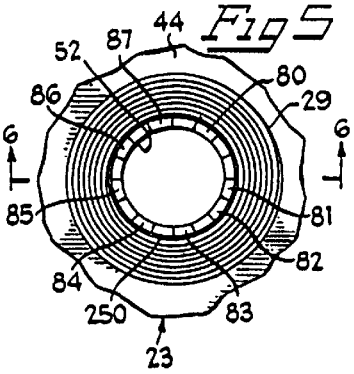
FIG. 5 of the drawings is an enlarged top view of one of the substantially circular pylon means shown in FIG. 1, showing in particular, the secured attachment of the articulateable flap means to the interior surface of the circular pylon means, as well as the adhesive used for attachment therebetween.

Top surface 44 of bottom panel means 23, is shown in FIG. 2, prior to attaching platform means 22 to top ends, such as top ends 55 and 60, (as shown in FIG. 1) of the pylon means, such as pylon means 26 through 34. Each of the pylon means are secured to top surface 44 of bottom panel means 23, by articulateable flap means, such as articulateable flap means 49 through 53. Each articulateable flap means, such as articulateable flap means 51, comprise a plurality of individual flap elements, such as flap elements 75 through 77, as shown in FIG. 3 The top surface of these flap elements are coated with an adhesive, such as adhesive 71, as shown in FIG. 1, prior to their attachment to interior walls, such as interior wall 59, of the pylon means, such as pylon means 26 as shown in FIG. 4. One type of adhesive coating which is recommend for use is a polyvinyl acetate, although any other type of suitable adhesive can also be used.

Figure 6:
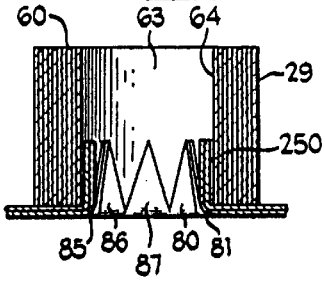
FIG. 6 of the drawings is an elevated partial cross-sectional side view of the circular pylon means shown in FIG. 5, taken along lines 6—6 and looking in the direction of the arrows, showing in particular, the star-burst pattern of the articulateable flap means, the operable positioning and maximized height of contact of the individual flaps to the interior surface of the pylon means, as well as the adhesive used to secure the flap means thereto.

Actual attachment of flap elements, such as flap element 75 through 78, as shown in FIG. 3, to the pylon means, such as pylon means 26, is accomplished by forcing the respective flap elements, into abutment with the interior walls, such as interior walls 59 and 64, as shown in FIG. 3 and FIG. 6, of pylon means 26 through 34. The adhesive, such as adhesive 71, applied to flap elements 75 through 78, as shown in FIG. 1, may be applied manually, by machine, or both to the interior walls of the respective pylon means for secured attachment therebetween. Also shown in FIG. 2, are aperture means 45 through 48 which facilitate operable acceptance of wheels 220 of a conventional material handling device, as shown in FIG. 9.

Also shown in FIG. 2 is alternative, substantially circular shaped aperture means 48*a*. Inasmuch as aperture means, such as aperture means 48*a*, are only necessary when apparatus 20 is raised and lowered by specific jack-type material handling devices requiring such apertures (such as the type shown in FIG. 9), it is contemplated that bottom panel means 23 alternatively be configured with disk element 48*b* which may be attached by a perforated region, in relatively planer relationship to top and bottom surfaces of bottom panel means 23. Accordingly, when necessary, disk element 48*b* may be automatically detached from bottom panel means 23 upon exertion of load-bearing force to disk element 48*b* itself-thereby providing the popping open aperture means 48*a*. Until that time, disk 48*b* contributes to the rigidity of bottom panel means 23. Although such detachment piece is shown as a circular disk shaped element 48*b*, other geometrically shaped configurations are also contemplated.

Two different shaped constructions of pylon means, such as pylon means 26 and 29, as shown in FIG. 1 and FIG. 2, are shown in FIGS. 3 through 6, along with their respective articulateable flap means 51 and 52 as attached thereto. In one embodiment, the invention includes two differently shaped pylon means, such as the substantially cylindrically shaped pylon means 29 through 31, and the substantially elongated, rectangular shaped pylon means 26, 27, 28, 32, 33, and 34, as shown in FIG. 1, and that each of these shaped pylons be secured to top surface 44 of bottom panel means 23 by individual flap elements, such as flap elements 75 through 78, and flap elements 80 through 87, which comprise articulateable flap means, such as articulateable flap means 51 and 52, respectively. Furthermore each of these flap elements have fold lines, such as fold line 72 as shown in FIG. 1, which are substantially similar to the configuration of the respective interior regions, such as interior regions 58 and 63, of the pylon means, such as pylon means 26 and 29, respectively, to which they are attached.

When substantially rectangular shaped articulateable flap means, such as articulateable flap means 51, are fully articulated, each of the respective flap elements, such as flap elements 75 through 78, may be positioned in abutment with a substantial portion of an interior wall, such as interior wall 59, of each of the rectangular shaped pylon means, such as pylon means 26, and secured thereto by adhesive means 231, 232, 230 and 233. Furthermore, each of these flap elements have been configured in such a manner as to maximize the height of contact with the respective interior wall they will be affixed to, for secured attachment therewith. As is true with the rectangular shaped flap means, when the substantially cylindrically shaped flap means, such as flap means 52 are fully articulated, each of the respective flap elements, such as flap elements 80 through 87, will have been forced into abutment with a substantial portion of interior walls, such as interior wall 64, of each cylindrically shaped pylon means, such as pylon means 29, and secured thereto by adhesive means 250. The star-burst like pattern of articulateable flap means, such as flap means 52, have been configured to maximize the height of contact, and accordingly securement to the interior wall, such as interior wall 64, of each of the cylindrically shaped pylon means, such as pylon means 29. Although one embodiment shows two particular configurations of articulateable flap means, such as articulateable flap means 51 and 52, other configurations are also contemplated for pylon means having the same geometrically elongated shape as those pylon means as shown in FIGS. 11 and 12. Also shown in FIGS. 3 through 6 are apex 77*a* of flap element 77, top ends 55 and 50 of pylon means 26 and 29, respectively, and adhesive means 230*a* and 231 a which can be applied to the bottom ends, such as bottom end 55*a*, as shown in FIG. 1, of pylon means, such as pylon means 26.

Substantially, rectangular shaped articulateable flap means, such as articulateable flap means 51, is shown in FIG. 7, prior to the actual articulation of flap elements 75 through 78, and accordingly, prior to their abutment and attachment with interior wall, such as interior wall 59, of the respective pylon means, such as pylon means 26, as shown in FIG. 3. As can be seen, this particular shaped flap means 51 has fold lines 72, about the flap elements, which substantially conforms with the interior region of a substantially rectangular shaped pylon means, such as pylon means 26 as shown in FIG. 1. The flap elements 75 through 78 are configured in such a way so as to maximize the height of contact with interior walls, such as interior wall 58, of pylon means, such as pylon means 26, as shown in FIG. 3. Such height and contact maximization is achieved by having the apexes, such as apex 77*a*, of the opposing side flap elements 76 and 77, abut with the apexes of the adjacently positioned end flap elements 75 and 78. Also shown in FIG. 7 is bottom panel means 23, and adhesive coating 71 as applied to top surface of flap elements 75 through 78, which as previously mentioned, could comprise a polyvinyl acetate adhesive. Adhesive 71*a* may likewise be positioned on panel 23 about the position of the flaps to adhesively cooperate with the abutting end of the pylon.

The operable positioning of pylon means, such as pylon means 26, 29, 30 and 31, between platform means 22 and bottom panel means 23, are shown in FIG. 8 and FIG. 9. When shipping platform apparatus 20 is fully assembled, bottom ends, such as bottom end 55*a*, of the pylon means, such as pylon means 26, will abut in secured attachment with top surface 44 of bottom panel means 23. Likewise, the top ends, such as top end 55, of the pylon means, such as pylon means 26, will abut in secured attachment with bottom surface 37 of platform means 22. As shown in FIG. 1, the top ends, such as top end 55, of each of the pylon means 26 through 34, are coated with an adhesive for attachment to bottom surface 37 of platform means 22. As is true with the articulateable flap means, attachment is accomplished by secured adhesion between the top ends of the pylon means to the bottom surface of the platform means 22. Through such a construction, bottom panel means 23 is attached to the pylons, such as pylon 26, through reinforced bottom attachment panel means including articulateable flap means 51 having articulateable flab elements such as flap elements 75 and 78 adhesively attached at regions 230–231 as well as through adhesive means 230*a* and 231*a* applied between the bottom of pylon 26 and the top of bottom panel 23, as shown in FIGS. 4 and 7. The pylon bottom attachment means will be more resistant against shear and torquing forces at the point of attachment between elongated pylons 26 and bottom panel 23 than the non or lesser reinforced pylon top attachment means securing the top ends of the pylon to the bottom surface of platform means 22. The stronger, more resistant securement of the pylons to the bottom panel means 23, as a result of reinforced attachment, through flap elements such as elements 75–78, will first induce failure of a pylon upon direct or indirect exposure of the pylons to shear and torquing forces, at the pylon top attachment means, before inducing failure of the pylon bottom attachment. This construction protects against a catastrophic cantilevering of the platform means 22 and the potentially substantial load supported thereby, relative to bottom panel means 23—such as when a forklift carrying the platform and a load strikes an adjacent pallet or nonyielding structure, or when the forklift tine strikes a pylon during rapid turning or abrupt maneuvers. Through such a construction, at worst, the pylon top attachment means could fail while maintaining restrained attachment of the bottom panel attachment means to preclude against the lateral and downward displacement (collapse) of platform means 22, with its supported load, which could otherwise cantilever relative to the position of the bottom panel means 23.

As was shown in greater detail in FIG. 1 and FIG. 2, shipping platform apparatus 20, comprises aperture means, such as aperture means 46 and 47. Inasmuch as pylon means, such as pylon means 29 through 31 may be positioned in distally spaced rows, or in otherwise offset positions, entrance of the fork tines of conventional material handling equipment therebetween as shown in FIG. 9, is made possible. When the tines are properly inserted, the weight bearing wheels, such as wheel 220, or other lifting or rolling mechanisms attached near the end of the tines, will be located within apertures, such as aperture 46. Accordingly, such placement will enable shipping platform apparatus 20 to be raised off of the ground surface while simultaneously allowing the wheel, such as wheel 220, of the fork tines, to remain in contact with the ground surface, thereby providing stability during such raising, lowering and transporting of shipping platform apparatus 20. Also shown in FIGS. 8 and 9 are top surface 36 of platform means 22.

Three alternative configuration of pylon means, such as pylon means 90 through 93, are shown in FIGS. 10 through 12, along with the respective articulateable flap means configurations used to secure each respective pylon means to the respective bottom panel means 106, 118 and 126. Specifically, pylon means 90 is shown in FIG. 10 as having a substantially oval elongated configuration with an interior region 94 which is also substantially oval. Oval pylon means 90 is secured to top surface 107 of bottom panel means 106, by adhesive contact with flap elements 95 through 104. As can be seen, the flap elements are surrounded by a fold line 240 which substantially conforms to the configuration of interior region 94 of pylon means 90. Furthermore, flap elements 95 through 102 are configured to maximize the height of contact within interior region 94 of pylon means 90, as well as the securement therebetween. Also shown in FIG. 10 is adhesive means 138 as applied to the top surface of each of the flap elements.

Two substantially cylindrically shaped and thus further elongated pylon means 91 and 92, may be positioned adjacent to each other, and secured to top surface 119 of bottom panel means 118, are shown in FIG. 11, along with flap elements, such as flap elements 110 through 117, which are used to secure cylindrically shaped pylon means, such as pylon means 91 and 92, to bottom panel means 118. Flap elements, such as flap elements, 110 through 117 are surrounded by fold lines, such as fold lines 241 and 242, which substantially conform to the configuration of interior regions, such as interior region 120, of cylindrically shaped pylon means, such as pylon means 91 and 92. Furthermore, the star-burst like pattern of flap elements, such as flap elements 110 through 117, facilitate maximum securement and height of contact within interior region, such as interior region 120, of pylon means 91 and 92. Also shown in FIG. 11 is adhesive means, such as adhesive means 139, as applied to the flap elements.

Substantially rectangular shaped elongated pylon means 93 is shown in FIG. 12, as well as the four flap configured flap elements 122 through 125 which are used to secure pylon means 93 to top surface 127 of bottom panel means 126. These flap elements are surrounded by fold line 245 which substantially conforms with interior region 128 of pylon means 93. Each flap element is coated with adhesive means 140 for secured attachment with corresponding pylon means 93. Also shown in FIG. 12 is hole 221 centrically positioned between flap elements 122 through 125.

Figure 13:
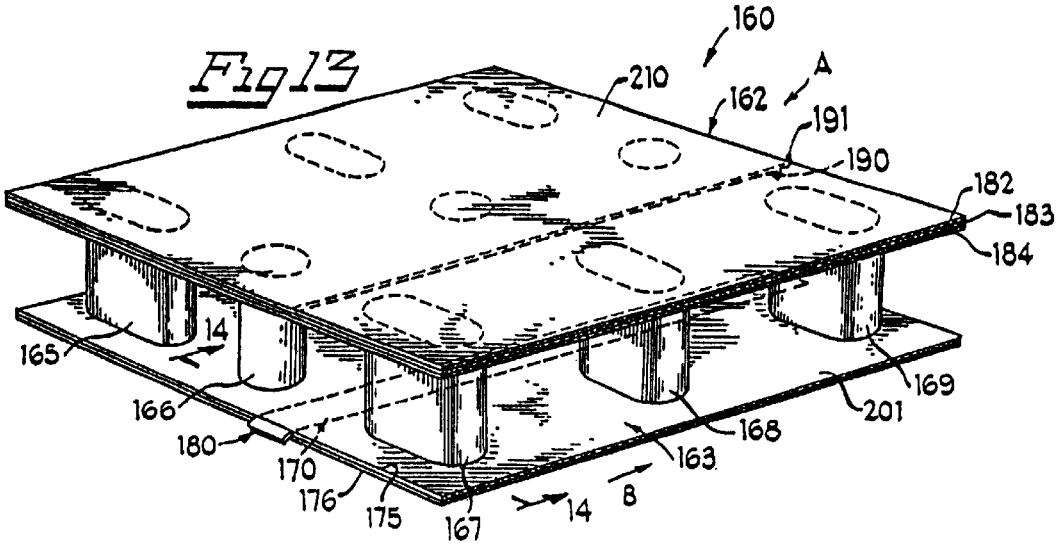
FIG. 13 of the drawings is a perspective view of the shipping platform apparatus, as fully assembled, showing, in particular, the triple corrugated layers of the top panel means, the double corrugated layers of the bottom panel means, as well as the frangibility means located in both the platform means and the bottom panel means.
Figure 14:
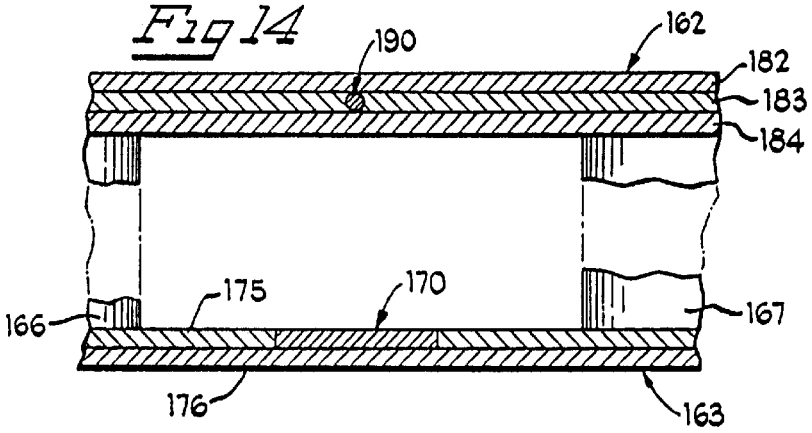
FIG. 14 of the drawings is a fragmentary cross-sectional view of the shipping platform apparatus of FIG. 13, taken along lines 14—14 of FIG. 13 and looking the direction of the arrows, particularly showing the tear strip embedded in the middle corrugated layer of the platform means and the tear strip embedded within the top corrugated layer of the bottom panel means.

Shipping platform apparatus 160 is shown in FIG. 13 and FIG. 14 as including platform means 162, bottom panel means 163, and pylon means, such as pylon means 165 through 169 operably positioned and secured therebetween. Platform means 162 is constructed with a top corrugated layer 182, middle corrugated layer 183, and bottom corrugated layer 184. Bottom panel means 163 is shown as having a double corrugated layer consisting of a top corrugated layer 175 and a bottom corrugated layer 176. While FIG. 13 shows an alternative construction, it is preferred that the corrugation pattern of platform means 162 be offset approximately 90 degrees to the corrugation pattern of bottom panel means 163, for optimal strength. Platform means 162 further includes tear strip 190 embedded within middle corrugated layer 183 and positioned across the entire width of platform means 162. Tear strip 190, here a wire tear strip includes pull tab 191 which facilitates removal of the tear strip when pulled in the direction of the arrow A. Additionally, bottom panel means 163 also includes tear strip 170. Tear strip 170, here a tape tear strip, is embedded within top corrugated layer 175 for facilitating total severing of bottom panel means 163 upon pulling pull tab 180 in the direction of the arrow B, as will be more fully explained. Also shown in FIG. 13 are top surfaces 210 and 201 of platform means 162, and bottom panel means 163, respectively.

Figure 15:
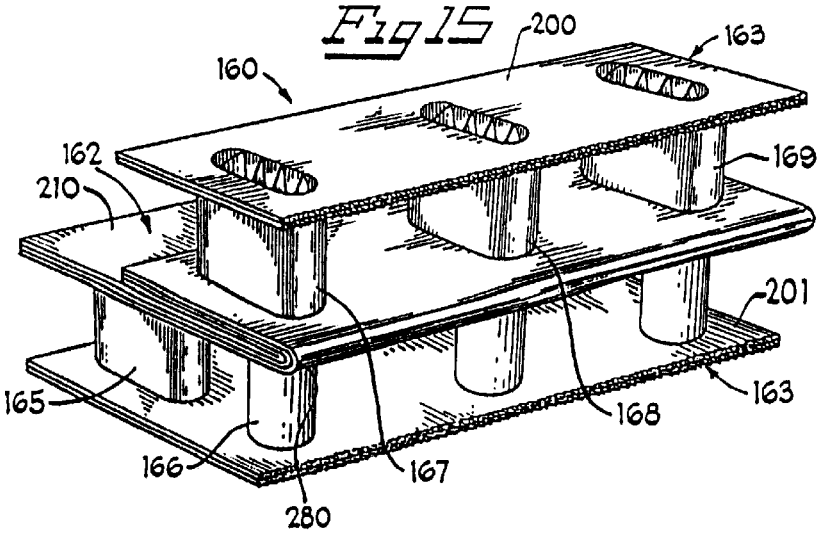
FIG. 15 of the drawings is a perspective view of the shipping platform apparatus of FIGS. 13 and 14 after the tear strips have been removed from the respective corrugated layers of the apparatus, showing in particular, the completely severed bottom panel means in position over the partially severed platform means.

Shipping platform apparatus 160 is shown in FIG. 15 after tear strip 190 has been removed from middle corrugated layer 183 of platform means 162, and after tear strip 170 has been removed from top corrugated layer 175 of bottom panel means 163, as shown in FIG. 13. Inasmuch as tear strip 190 is embedded in middle corrugated layer 183, its removal, by pulling tab 191 in the direction of the arrow A, will only cause the top two corrugated layers 182 and 183 to sever, as shown in FIG. 13. Accordingly, bottom corrugated layer 184 remains substantially intact yet foldable due to the reduced strength of platform means 162 (as a result of the partial severing), at fold point 280.

To actually induce foldability of platform means 162, tear strip 170 must be pulled in the direction of arrow B, as shown in FIG. 13, after apparatus 160 has been flipped over so that top surface 210 of platform means 162 is adjacent to the ground surface. Accordingly, since tear strip 170 is embedded within top layer 175 of bottom panel means 163, complete severing of bottom panel means 163 will occur. Once bottom panel means 163 is completely severed, and top two layers 182 and 183 of platform means 162 are completely severed, shipping platform apparatus 160, can be folded over at fold line 280 so as to substantially reduce the overall dimension of the apparatus 160. Such reduction in size will thereby facilitate disposal of shipping platform apparatus 160 in a conventional compactor or other type of refuse bin after use. Also shown in FIG. 15 is top and bottom surfaces 201 and 200, respectively, of bottom panel means 163, and pylon means 165 through 169.

Additional contemplated flap element configurations are shown in FIGS. 16, 17 and 18 prior to the actual articulation of the respective flap elements to the inner wall of a corresponding pylon. Specifically, FIGS. 16, 17 and 18 each show flap means 234, 243 and 245, respectively, which are configured for attachment to pylons having substantially rectangular configurations. Flap means 234, as shown in FIG. 16, is shown having separation lines 235 and 236, which define four triangular shaped flap elements. Flap means 243, as shown in FIG. 17, includes separation line 244 which define two substantially rectangular flap elements. Flap means 245, as shown in FIG. 18, includes one separation line 246. However, unlike separation line 244 in FIG. 17, separation line 246 defines two triangular shaped flap elements. All of these flap configurations are contemplated as alternatives for maximizing, alternatively, the width and/or height of contact, to accordingly enhance securement to, the respective interior wall of a rectangular shaped pylon.

Flap means 247 is shown in FIG. 19 prior to articulation of the individual flap elements, and accordingly prior to attachment to a pylon similar in shape to the outer peripheral elongated hexagonal configuration of flap means 247. As can be seen, flap means 247, comprises six separation lines 248, 249, 251, 252, 253 and 254 which serve to define six triangular shaped flap elements. Such a configuration is contemplated for purposes of maximizing the height of contact to accordingly enhance adhesive securement to a pylon having an interior wall with a configuration substantially similar to the elongated hexagonal shape of flap means 247.

Figure 20:
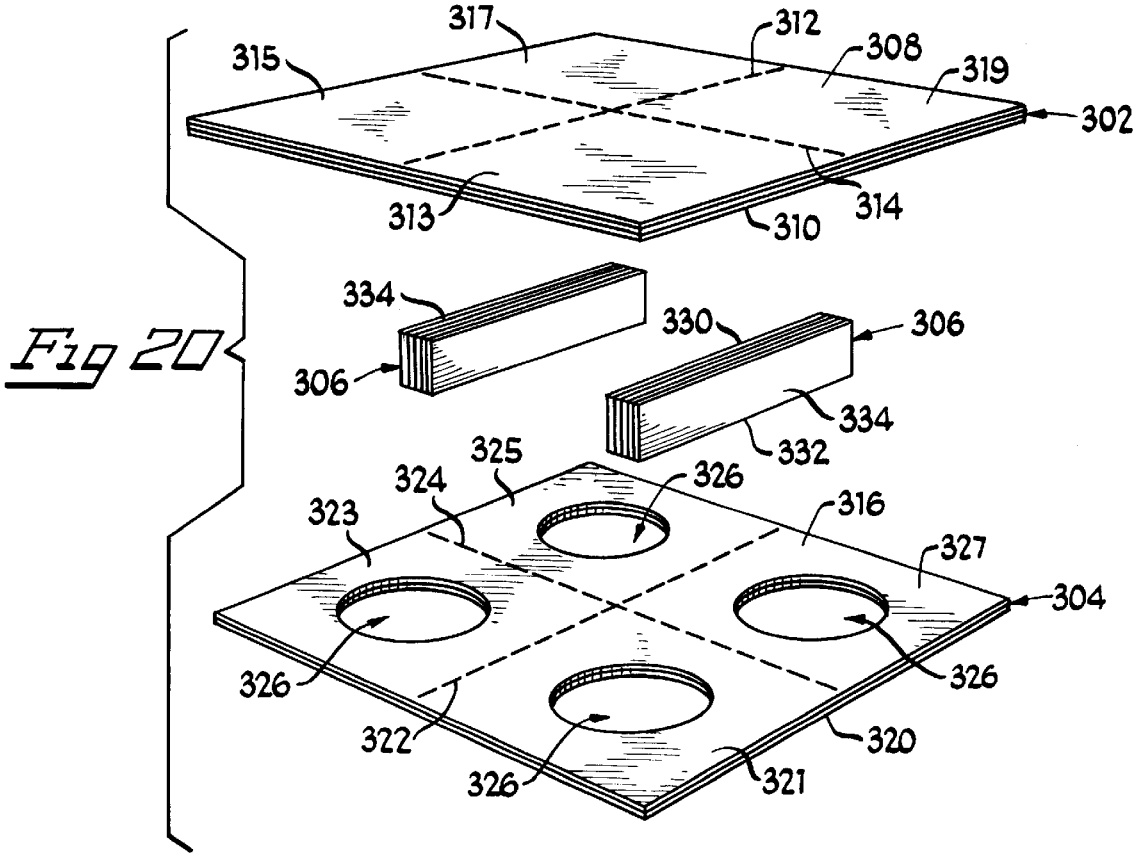
FIG. 20 of the drawings is a an exploded perspective view of the divisible shipping platform apparatus according to the present invention.
Figure 21:
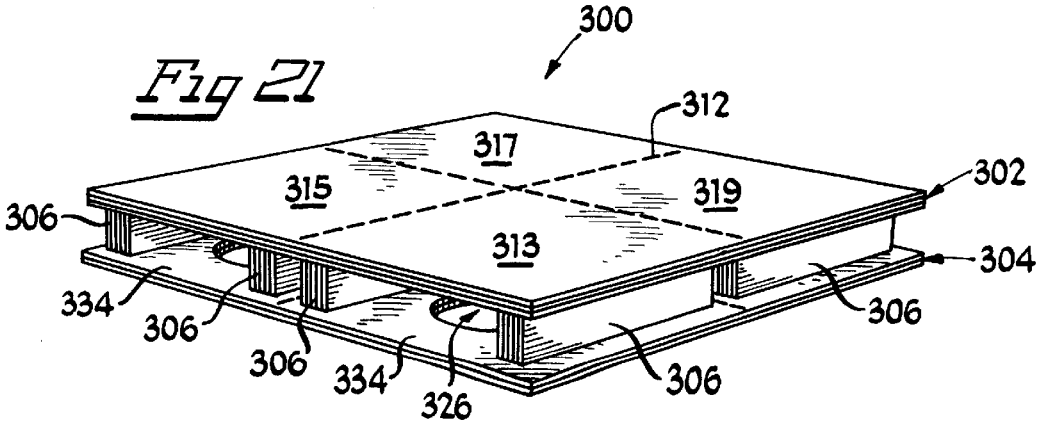
FIG. 21 of the drawings is a perspective view of the articulated divisible shipping platform apparatus according to the present invention.

Divisible shipping platform apparatus 300 is shown in FIGS. 20 and 21 as comprising platform member 302, bottom panel member 304, and pylons 306. Platform member 302 comprises top load bearing surface 308, bottom surface 310, longitudinal frangibility line 312, and transverse frangibility line 314. Although platform member 302 preferably consists of multiple layers of corrugated paperboard, with each layer having a parallel direction of corrugation for increased unidirectional strength, it is likewise contemplated that platform member 302 consists of any number of layers of corrugated paperboard. For instance, while platform member 302 is shown as consisting of three layers of corrugated paperboard, platform member 302 may consist of one, two, or any number of layers desired for a particular application.

Platform member longitudinal frangibility line 312 preferably spans the entire length of platform member 302, and extends all the way through the thickness of the platform member to allow the complete severing thereof. Likewise, transverse frangibility line 314 preferably spans the width of platform member 302, and extends all the way through the thickness of the platform member to facilitate complete severing thereof. To this end, frangibility lines 312 and 314 preferably comprise a series of perforations, with each perforation having a predetermined configuration and length. However, it is likewise contemplated that frangibility lines 312 and 314 may consist of a tear strip imbedded in the entire thickness of the platform member thickness, so as to allow complete severing of platform member 302 along lines 312 and 314.

Moreover, although frangibility lines 312 and 314 may be positioned at any point across the length and width of platform member 302, it is preferred that the frangibility lines divide the platform member into four substantially equally sized regions, such as divisible regions 313, 315, 317, and 319 illustrated in FIGS. 20 and 21. Furthermore, while it is preferred that both frangibility lines 312 and 314 are used to create four divisible regions, it is certainly contemplated that platform member 302 includes only one frangibility line spanning the longitudinal or transverse length thereof, thus dividing the platform member into two divisible regions.

Bottom panel member 304 comprises top surface 318, bottom surface 320, longitudinal frangibility line 322, transverse frangibility line 324, and apertures 326. Although bottom panel member 304 also preferably consists of multiple layers of corrugated paperboard, with each layer having a parallel direction of corrugation for increased unidirectional strength, the bottom panel member may consists of any number of layers of corrugated paperboard. For instance, while bottom panel member 304 is shown as consisting of two layers of corrugated paperboard, bottom panel member 304 may consist of one or more layers desired for a particular application. Preferably, the direction of corrugation of the bottom panel member runs transverse to the direction of corrugation of the platform member, so as to impart increased multi-directional strength on the divisible shipping platform apparatus upon articulation.

Like platform member frangibility lines 312 and 314, bottom panel frangibility lines 322 and 324 preferably span the entire length and width of bottom panel member 304, respectively, and extend all the way through the thickness of the bottom panel member to facilitate complete severability thereof. Also like the platform member frangibility lines, bottom panel member frangibility lines 322 and 324 preferably comprise a series of perforations, with each perforation having a predetermined configuration and length—although it is likewise contemplated that frangibility lines 322 and 324 may consist of a tear strip imbedded in the entire thickness of the bottom panel member. Moreover, bottom panel frangibility lines 322 and 324 are preferably in substantial alignment with platform member frangibility lines 312 and 314, thus creating substantially equally sized bottom panel divisible regions 321, 323, 325, and 327—which are preferably of the same approximate size of platform member divisible regions 313, 315, 317, and 319. Of course, a single perforation line dividing bottom panel member 304 into two divisible regions is likewise contemplated.

Although the frangibility lines in the platform member and bottom panel member are preferably in substantial alignment, platform member frangibility lines 312 and 314 may be at least partially misaligned from bottom panel frangibility lines 322 and 324 to prevent inadvertent or premature separation of the divisible shipping platform. Moreover, platform member frangibility lines 312 and 314 may have a different configuration and length than bottom panel member frangibility lines 322 and 324. Inasmuch as the configuration and length of the frangibility line perforations determines the frangibility threshold of the corresponding platform or bottom panel member, this difference in perforation configuration and/or length imparts a different frangibility threshold on the platform member as compared to the frangibility threshold of the bottom panel member. As described in more detail below, such a difference in frangibility thresholds facilitates division of shipping platform 300 by material handling devices.

Bottom panel member apertures 326 are positioned in each divisible region 321, 323, 325, and 327—preferably centered in each of the four divisible regions. Although shown as substantially circular in shape, apertures 326 may take any shape, including square, rectangular, triangular, etc., allowing cooperation with conventional material handling devices. Moreover, although apertures are preferred, bottom panel member 304 may also comprise detachable perforated regions substantially centered in each of the four divisible regions, as described above in reference to FIG. 2.

Pylons 306 comprise top end 330, bottom end 332, and outer surface 334. As can be seen in FIGS. 20–25, pylons 306 are preferably elongated in shape, to provide the maximum supportable strength for a load placed on platform member 302. Indeed, while pylons 306 are preferably of a length substantially spanning the length of the platform member and bottom panel member divisible regions, smaller pylons may also be used. Specifically, the smaller pylons may be placed at the four corners of the divisible regions, thus creating insertion openings on each side of divisible shipping platform 300. Likewise, the pylons may be placed proximate the central point of the length or width of the platform member and bottom panel member divisible regions.

Moreover, any of a number of different pylons shapes and configurations may be used in combination with the present invention, including non-elongated, hollow, square, rectangular, circular, oval, etc., or combinations thereof, as would be understood by those with ordinary skill in the art with the present disclosure before them. For instance, although shown in FIGS. 20 and 21 as constructed from multiple layers of corrugated paperboard, pylons 306 may likewise be constructed from concentric layers of paperboard, a continuous rolled piece of corrugated paperboard, or other conventional constructions. Furthermore, pylons 306 may further comprise articulateable flap means, as described hereinabove.

To articulate divisible shipping platform apparatus 300, pylons 306 are placed between platform member 302 and bottom panel member 304. Top ends 330 of pylons 306 are secured to bottom surface 310 of platform member 302, and bottom ends 332 of pylons 306 are secured to top surface 316 of bottom panel member 304. This securing may be accomplished with an adhesive, such as polyvinyl acetate, glue, or other securing element as would be readily understood by those with ordinary skill in the art with the present disclosure before them. Positioned between platform member 302 and bottom panel member 304, pylons 306 are used not only to separate platform member 302 from bottom panel member 304, but also as structural supports when a load is placed on platform member 302.

Upon articulation, divisible shipping platform 300 is capable of accepting a load placed on top load bearing surface 308 to facilitate handling, lifting, and transportation of the load bearing divisible shipping platform 300. Fork lift tines from conventional and tined material handling devices may then be positioned inside tine insertion gaps 334. Notably, the tines may be inserted from two positions, either the front of the divisible shipping pallet or the rear of the divisible shipping pallet—whichever entry site may be most convenient. Of course, the use of four smaller pylons positioned at the corner of each platform member and bottom panel member divisible region would enable the insertion from four platform entry sites—on each side of the shipping platform. Apertures 326 enable cooperation with the material handling devices, allowing a stabilizing member, such as a load supporting wheel, to contact the ground or other shipping platform support surface during raising and lowering of divisible shipping platform 300.

Figure 22:
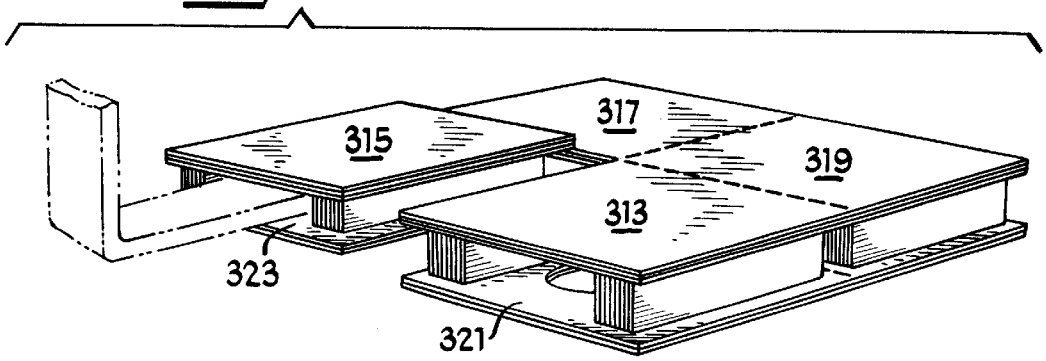
FIG. 22 of the drawings is a perspective view of an independent shipping platform unit being separated from the divisible shipping platform apparatus according to the present invention.

As is shown in FIG. 22, to divide shipping platform 300, the material handling device raising member, for instance a tine, need only raise the portion of the shipping platform desired to be separated from the remainder of the platform. By raising the forklift tine, a force is exerted by the tine on bottom surface 310 of platform member 302. This force, in turn, exerts an upward severing stress on platform member frangibility lines 312 and 314. Inasmuch as a portion of the load still preferably remains on the unraised portions of platform member 302, the stress easily severs the platform member along the frangibility lines and separates the platform member divisible region, for instance region 315, being lifted by the forklift tine. Inasmuch as the corresponding bottom panel member divisible region, for instance region 323, is adhesively attached to pylons 306, which, in turn, are adhesively attached to divisible region 315, bottom panel member divisible region 323 is simultaneously separated from the rest of bottom panel 304. Because there is no load resting directly upon the top surface of bottom panel member 304, frangibility lines 322 and 324 may be configured to have a lower frangibility threshold than platform member frangibility lines 312 and 314 to facilitate separation.

Figure 23:
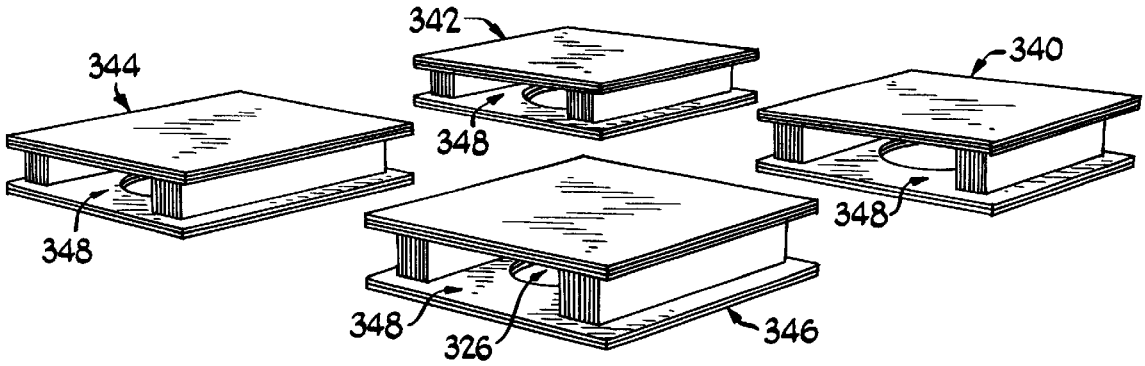
FIG. 23 of the drawings is a perspective view of the divisible shipping platform apparatus as separated into four independent shipping platform units according to the present invention.
Figure 24:
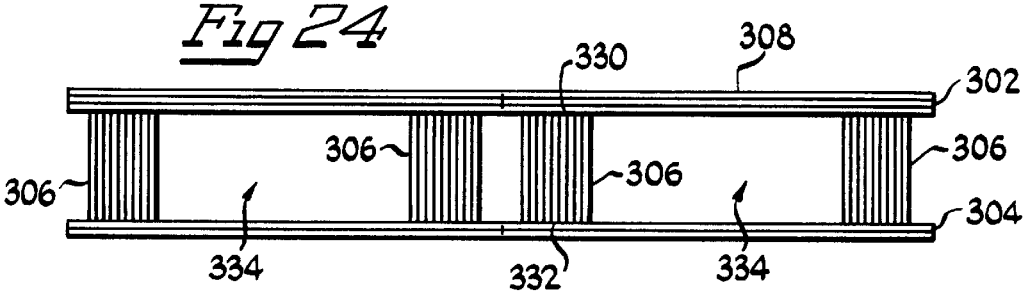
FIG. 24 of the drawings is a front elevational view of the divisible shipping platform apparatus according to the present invention.
Figure 25:
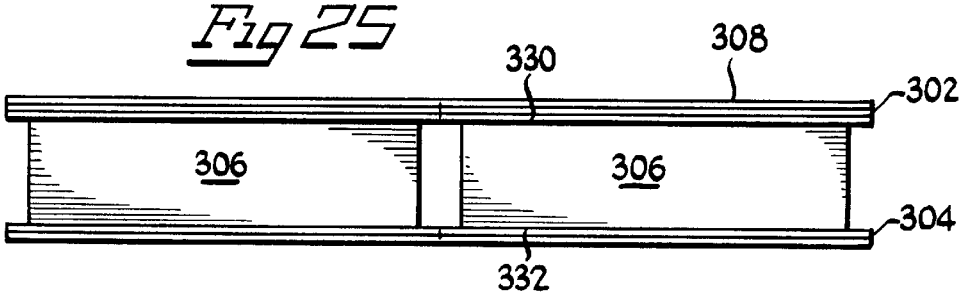
FIG. 25 of the drawings is a side elevational view of the divisible shipping platform apparatus according to the present invention.

As is shown in FIG. 23, divisible shipping platform 300 may be divided into independent shipping platform units, such as independent units 340, 342, 344, and 346. Like the original divisible shipping platform 300, each smaller independent unit is capable of accepting fork lift tines from conventional and tined material handling devices, which tines may be positioned into tine insertion gaps 348 to facilitate handling, lifting, and transportation of the independent shipping platform units. Also like divisible shipping platform 300, the tines may be inserted from two different tine insertion positions, or from four tine insertion positions if the above described alternative pylon configuration is used. Moreover, apertures 326 in the independent shipping platform units still enable cooperation with material handling devices, allowing a stabilizing member to pass through the bottom panel and contact the shipping platform support surface.

Figure 26:
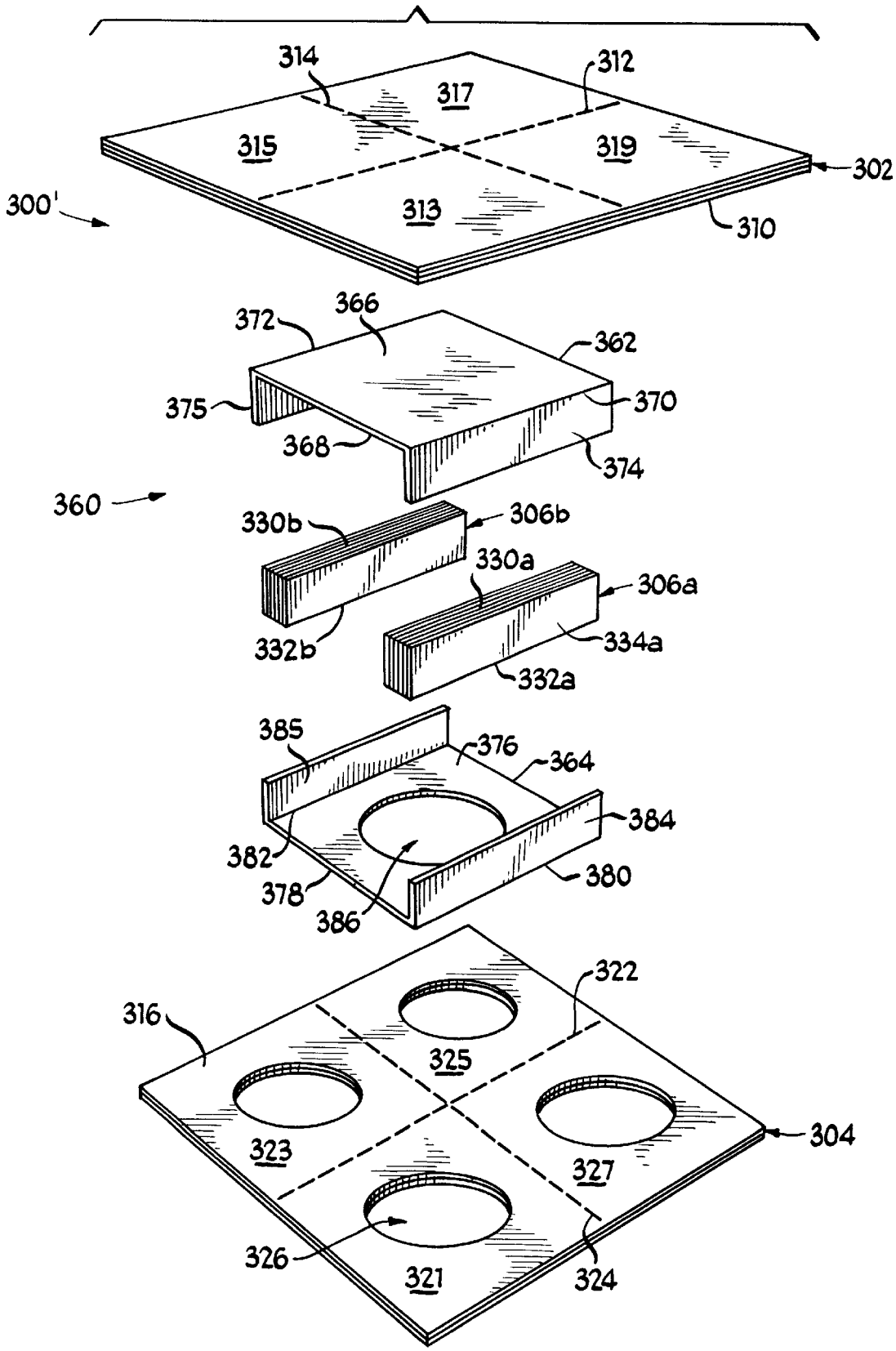
FIG. 26 of the drawings is an exploded perspective view of a divisible shipping platform apparatus with a pylon sleeve according to another embodiment of the present invention.
Figure 27:
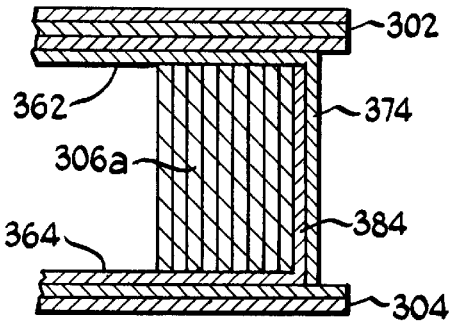
FIG. 27 of the drawings is a fragmented front elevational view of the divisible shipping platform apparatus with pylon sleeve shown in FIG. 26.

In another embodiment, shown in FIGS. 26 and 27, divisible shipping platform apparatus 300' comprises platform member 302, bottom panel member 304, and pylon sleeve 360 for operably housing pylons 306*a* and 306*b*. Pylon sleeve 360 comprises top sleeve member 362 and bottom sleeve member 364. Top sleeve member 362 includes top surface 366, bottom surface 368, first side edge 370, second side edge 372, first top sleeve member side panel 374, and second top sleeve member side panel 375. Likewise, bottom sleeve member 364 includes top surface 376, bottom surface 378, first side edge 380, second side edge 382, first bottom sleeve member side panel 384, and second bottom sleeve member side panel 385. Additionally, bottom sleeve member 364 further includes aperture 386, preferably having a shape substantially corresponding to the shape of aperture 326 in bottom panel member 304.

To prepare pylon sleeve 360 for positioning between platform member 302 and bottom panel member 304, bottom ends 332*a* and 332*b* of pylons 306*a* and 306*b* are secured to top surface 376 of bottom sleeve member 364, preferably substantially along first side edge 380 and second side edge 382, respectively. First bottom sleeve member side panel 384 is then secured to outside surface 334*a* of pylon 306*a* and second bottom sleeve member side panel 385 is attached to outside surface 334*b* of pylon 306*b*. Next, top ends 330*a* and 330*b* of pylons 306*a* and 306*b* are secured to bottom surface 368 of top sleeve member 362, preferably substantially along first side edge 370 and second side edge 372, respectively. Inasmuch as the first and second bottom sleeve member side panels are secured to the outside surface of pylons 306*a* and 306*b*, first top sleeve member side panel 374 is secured to first bottom sleeve member side panel 384, and second top sleeve member side panel 375 is secured to second bottom sleeve member side panel 385. While attachment is preferably by an adhesive such as described above, any conventional securing element is likewise contemplated.

To articulate divisible shipping platform 300', pylon sleeve 360 is positioned between platform member 302 and bottom panel member 304. To secure pylon sleeve 360, top surface 366 of top sleeve member 362 is secured to bottom surface 310 of platform member 302, and bottom surface 378 of bottom sleeve member 364 is secured to top surface 316 of bottom panel member 304. Again, this securing may be accomplished with any adhesive, glue, or securing element as would be readily understood by those with ordinary skill in the art with the present disclosure before them. Inasmuch as aperture 386 in bottom sleeve member 364 has a shape and configuration substantially corresponding to the shape and configuration of bottom panel member aperture 326, apertures 386 and 326 are preferably in substantial alignment—thus allowing for cooperation between the pylon sleeve, the bottom panel member, and a material handling device. Indeed, like the alternative construction of bottom panel member 304 described above, namely substitution of a detachable perforated region for the aperture, bottom sleeve member 364 may also include a detachable perforated region instead of an aperture.

Moreover, pylon sleeve 360 preferably has a size and shape approximating that of platform member divisible regions 313, 315, 317, and 319 and bottom panel member divisible regions 321, 323, 324, and 327. Of course, although only one pylon sleeve is shown in FIG. 26, it will be understood that the number of pylon sleeves matches the number of divisible regions in the platform member.

The use of pylon sleeves 360 facilitate division of shipping platform 300' into independent shipping platform units. In particular, top sleeve member 362 and bottom sleeve member 364 provide a greater surface area of contact and adhesion between the pylons and the platform member and bottom panel member—thus more securely integrating the platform member with the bottom panel member. Accordingly, any force applied to pylon sleeve 360, and, in turn, the associated individual platform member and bottom panel divisible regions is distributed over both divisible regions, and the independent shipping platform unit is more easily severed from original shipping platform 300'. Of course, it is likewise contemplated that shipping platform may comprise the platform member, pylons, and pylon sleeve—without bottom panel member 304.

Figure 28:
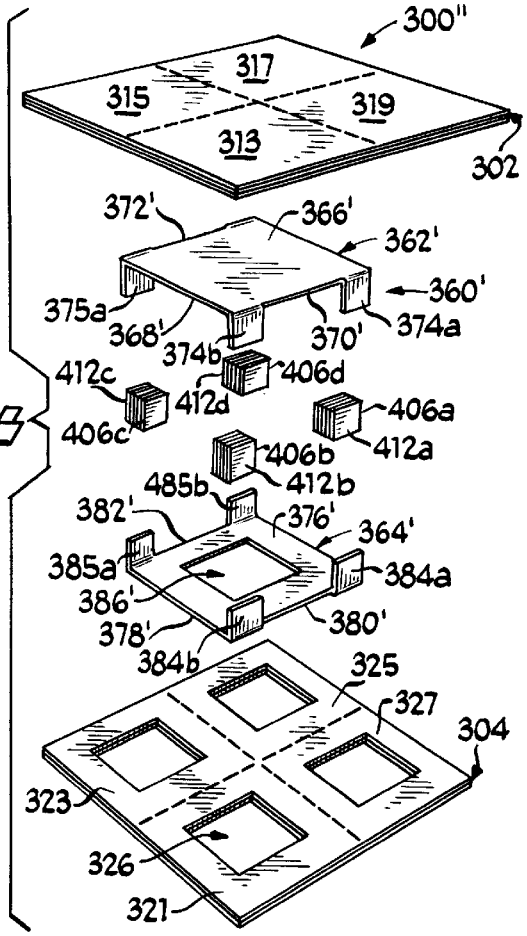
FIG. 28 of the drawings is an exploded perspective view of a divisible shipping platform apparatus with a pylon sleeve allowing tine entry at each of the four divisible shipping platform sides according to another embodiment of the present invention.
Figure 29:
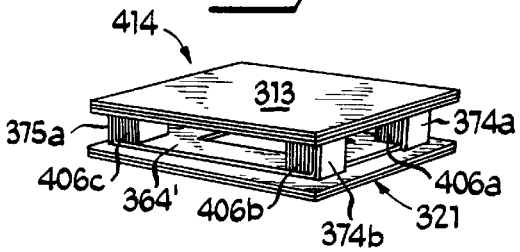
FIG. 29 of the drawings is a perspective view of an independent shipping platform unit as separated from the divisible shipping platform apparatus shown in FIG. 28.

In another embodiment, shown in FIGS. 28 and 29, divisible shipping platform 300" comprises platform member 302, bottom panel member 304, pylon sleeve 360', and pylons 406*a*, 406*b*, 406*c*, and 406*d*. Although shown as substantially square, pylons 406*a*–406*d*, like pylons 306, 306*a*, and 306*b* described in reference to FIGS. 20–27, may take any elongated, non-elongated, hollow, multi-layered, or coiled configuration. However, instead of spanning the entire length of top sleeve member 362' and bottom sleeve member 364', pylons 406*a*–406*d* leave gaps in a portion of those lengths for tine insertion.

Pylon sleeve 360' comprises top sleeve member 362' and bottom sleeve member 364'. Top sleeve member includes top surface 366', bottom surface 368', first side edge 370', second side edge 372', first top sleeve member side panels 374*a* and 374*b*, and second top sleeve member side panels 375*a* and 375*b*. Likewise, bottom sleeve member 364' includes top surface 376', bottom surface 378', first side edge 380', second side edge 382', first bottom sleeve member side panels 384*a* and 384*b*, and second bottom sleeve member side panels 385*a* and 385*b*. Additionally, bottom sleeve member 364' further includes aperture 386', preferably having a shape substantially corresponding to the shape of the aperture in bottom panel member 304 for substantial alignment upon articulation of divisible shipping platform 300".

In preparation of pylon sleeve 360' for positioning between platform member 302 and bottom panel member 304, the bottom ends of pylons 406*a*–406*d* are secured to top surface 376' of bottom sleeve member 364', preferably substantially along first side edge 380' and second side edge 382', respectively. First bottom sleeve member side panels 384*a* and 384*b* are then secured to outside surfaces 412*a* and 412*b* of pylons 406*a* and 406*b*, respectively, and second bottom sleeve member side panels 385*a* and 385*b* are secured to outside surfaces 412*c* and 412*d* of pylons 406*c* and 406*d*, respectively. Subsequently, the top ends of pylons 406*a*–406*d* are secured to bottom surface 368' of top sleeve member 362', preferably substantially along first side edge 370' and second side edge 372', respectively. Inasmuch as the first and second bottom sleeve member side panels are secured to the outside surfaces of pylons 406*a*–406*d*, first top sleeve member side panels 374*a* and 374*b* are secured to first bottom sleeve member side panels 384*a* and 384*b*, and second top sleeve member side panels 375*a* and 375*b* are secured to second bottom sleeve member side panels 385*a* and 385*b*.

Like pylon sleeve 360 of divisible shipping platform 300' discussed in relation to FIG. 26, pylon sleeve 360' is secured between platform member 302 and bottom panel member 304 for use in association with tined material handling equipment. However, unlike divisible shipping platform 300', divisible shipping platform 300" allows for tine entry at four sites, namely at each side of platform 300". Indeed, upon division of platform 300" into independent shipping platform units, such as shipping platform unit 414, the independent shipping platform units also allow for tine entry at four tine entry sites. This four-site entry capability eliminates the need for manipulation of the independent shipping platform units before engagement with a material handling device.

Figure 30:
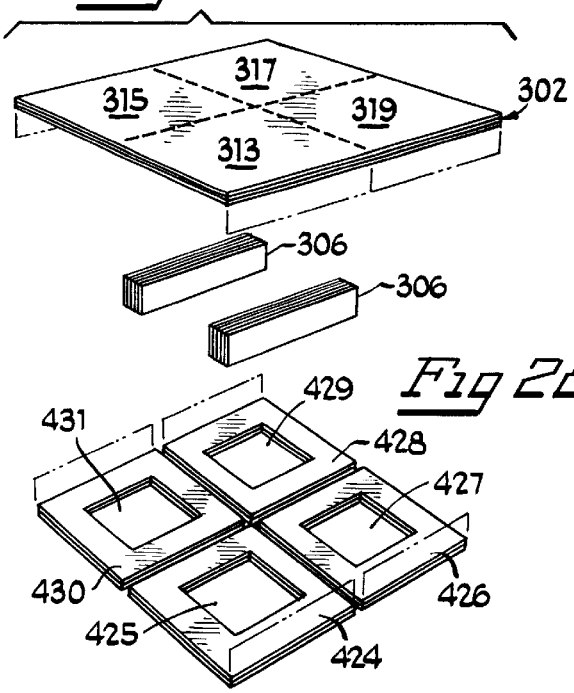
FIG. 30 of the drawings is an exploded perspective view of a divisible shipping platform apparatus with independent bottom panels according to yet another embodiment of the present invention.

In yet another embodiment, shown in FIG. 30, divisible shipping platform 420 comprises platform member 302, pylons 306, and bottom panels 424, 426, 428, and 430. While platform member 302 contains frangibility lines as described above in reference to FIGS. 20–25, bottom panel member 304 is replaced by four bottom panels 424, 426, 428, and 430. The bottom panels includes apertures 425, 427, 429, and 431 for cooperation with material handling devices.

To articulate divisible shipping platform 420, the top ends of pylons 306 are operably secured to the bottom surface platform member 302 with each platform member divisible region 313, 315, 317, and 319, thus defining a set of pylons. The bottom ends of each set of pylons are then adhered to the top surface of each respective bottom panel 424, 426, 428, and 430. Upon articulation, tines from a material handling device may then be inserted between the platform member and the bottom panels for transportation and handling of platform 420. To divide shipping platform 420 into independent shipping units, a tine exerts an upward force on a platform member divisible region and its associated frangibility lines. Because there is no frangibility threshold for the separated bottom panels, the upward tine force need only overcome the frangibility threshold of the platform member frangibility lines to sever the platform member from the platform member, and to create an isolated, independent shipping platform unit.

Moreover, as is shown in phantom, platform member 302 may further comprise side panels foldably emanating from opposing side edges of the platform member to assist in securing pylons 306 and/or increasing the integrity of the divisible regions. Likewise, the bottom panels may also consist of similar side panels. Additionally, although shown as being accessible from two tine entry positions by a tined material handling device, it is likewise contemplated that the pylons are configured such that both the divisible shipping platform 420 and the independent shipping platform units are tine accessible from four tine entry positions.

Figure 31:
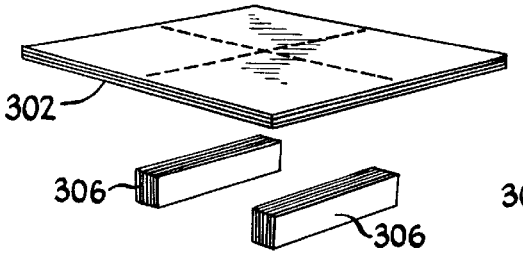
FIG. 31 of the drawings is an exploded perspective view of a divisible shipping platform apparatus comprising only a platform member and pylons according to still another embodiment of the present invention.
Figure 32:
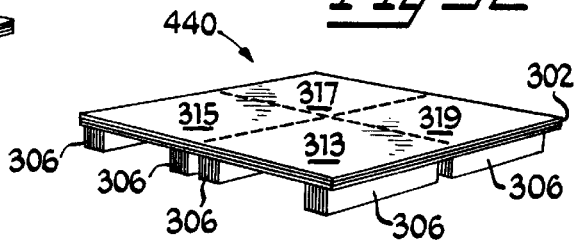
FIG. 32 of the drawings is a perspective view of the articulated divisible shipping platform apparatus according to the embodiment of the present invention shown in FIG. 31.

Of course, and as is shown in FIGS. 31 and 32 in yet another embodiment, divisible shipping platform 440 may comprise divisible platform member 302 and pylons 306—without a divisible bottom panel, as was described in reference to FIGS. 20–29, or a series of bottom panels, as was described in reference to FIG. 30. Notably, divisible shipping platform 440 is contemplated for use in applications where a bottom panel is unnecessary. Likewise, divisible shipping platform 440 may also be used in association with at least one pylon sleeve, as described above in reference to FIGS. 26–29.

Figure 34:
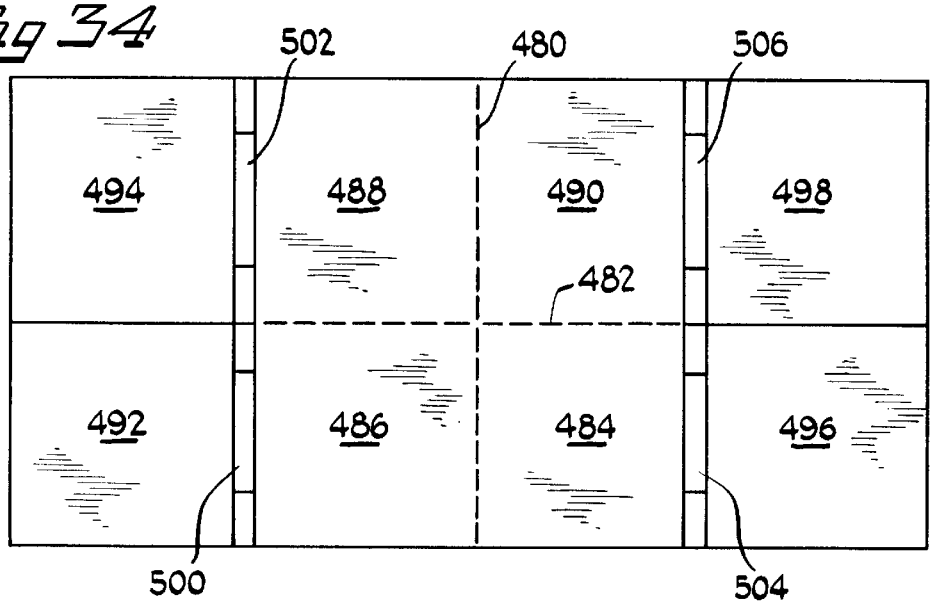
FIG. 34 of the drawings is a top plan view of a substantially unitary blank for forming a divisible shipping platform apparatus according to another embodiment of the present invention.
Figure 33:
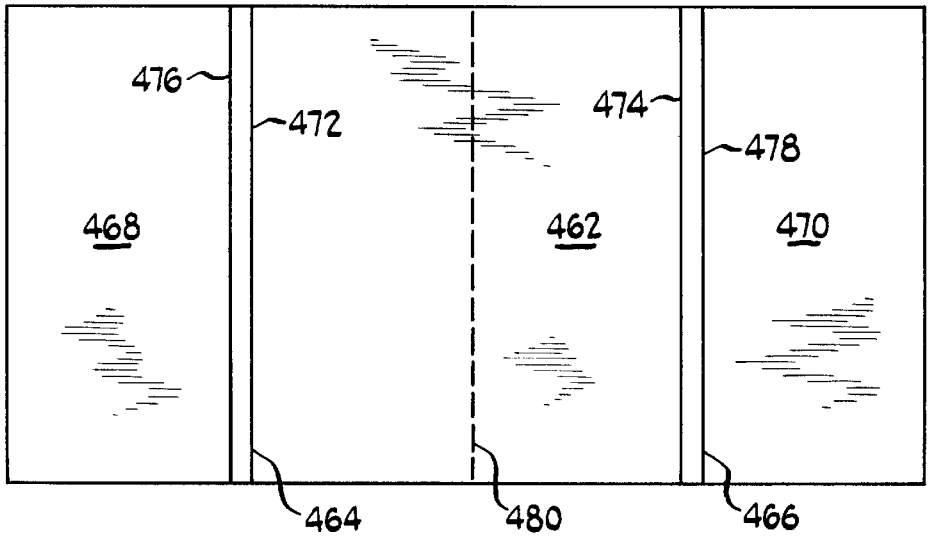
FIG. 33 of the drawings is a top plan view of a substantially unitary blank for forming a divisible shipping platform apparatus according to another embodiment of the present invention.
Figure 35:
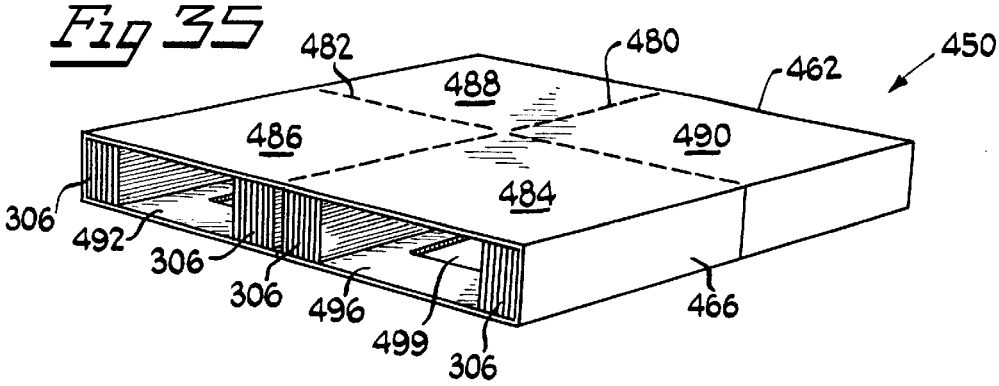
FIG. 35 of the drawings is a perspective view of a divisible shipping platform apparatus according to another embodiment of the present invention.

In another embodiment, shown in FIGS. 33–35, divisible shipping platform 450 is constructed from paperboard blank 460 comprising top panel 462, first side panel 464, second side panel 466, first bottom wing panel 468, and second bottom wing panel 470. First side panel 464 foldably emanates from first edge 472 of top panel 462, and second side panel 466 foldably emanates from second edge 474 of top panel 462. Likewise, first bottom wing panel 468 foldably emanates from first edge 476 of first side panel 464 and second bottom wing panel 470 foldably emanates from first edge 478 of second side panel 466.

Top panel 462 further includes frangibility line 480 for complete severability thereof, which, as described above, may comprise a perforation, score line, or tear strip. As is described below, frangibility line 480 allows division of divisible shipping platform 450 into two independent shipping platform units. Of course, as shown in FIG. 34, it is likewise contemplated that the blank may further comprise frangibility line 482 configured transverse to frangibility line 480 and spanning the entire length of the blank—which frangibility line runs across each of the first bottom wing panel, the first side panel, the top panel, the second side panel, and the second bottom wing panel. Frangibility line 482 defines top panel divisible regions 484, 486, 488, and 490; first bottom wing panel divisible regions 492 and 494; and second bottom wing panel divisible regions 496 and 498. Frangibility line 482 allows division of divisible shipping platform 450 into four independent shipping platform units. Indeed, it is also contemplated that first bottom wing panel, first side panel, second bottom wing panel, and second side panel may be completely severed along frangibility line 482 before articulation of blank 460—so as to facilitate division of divisible shipping platform 450.

Although only shown in reference to FIG. 35, first bottom wing panel 468 and second bottom wing panel 470 may also consist of apertures 499 or removable perforated regions to facilitate cooperation with material handling equipment.

Preferably, such apertures or removable regions are centered in each bottom wing panel divisible region 492, 494, 496, and 498.

Moreover, first side panel 464 and second side panel 466 may further comprise apertures 500, 502, 504, and 506 or removable perforated regions so as to facilitate insertion and removal of forklift tines from the sides of divisible shipping platform 450. Likewise, such a construction also allows tine entry and removal from each side of the independent shipping platform units formed by division of divisible shipping platform 450.

To articulate blank 460, pylons 306, described hereinabove, are secured to top panel 462. At least one pylon for each top panel divisible region 486 and 488 is preferably placed proximate top panel first edge 472, and at least one pylon for each top panel divisible region 484 and 490 is preferably placed proximate top panel second edge 474. Likewise, at least one pylon for each top panel divisible region 484, 486, 488, and 490 is placed proximate frangibility line 480. Moreover, although pylons 306 are shown as spanning the substantial length of each top panel divisible region, it is likewise contemplated that pylons 306 may be configured so as to be arranged in each corner of each top panel divisible region—similar to the arrangement described in reference to FIG. 28 above. Such an arrangement, in combination with apertures 500, 502, 504, and 506 in first side panel 464 and second side panel 466, allows for insertion of material handling device tines from all four sides of divisible shipping platform 450, and from all four sides of the independent shipping platform units formed by division of platform 450.

Next, first side panel 464 and second side panel 466 are folded so as to be substantially perpendicular to top panel 462. In this position, first side panel 464 and second side panel 466 preferably abut the outside surface of the pylons positioned proximate the top panel first and second edges, respectively. Accordingly, the first and second side panels may be secured to the outer surfaces of the respective pylons for increased integrity of the divisible shipping platform and, upon division, the independent shipping platform units.

First bottom wing panel 468 and second bottom wing panel 470 are then folded to come into contact with the bottom end of pylons 306, and subsequently secured thereto. In this position, first bottom and second bottom wing panels 468 and 470 are substantially perpendicular to first and second side panels 464 and 466, but substantially parallel and distally spaced from top panel 462. Although the ends of first bottom wing panel 468 and second bottom wing panel 470 are shown as coming together in substantially abutment, it is likewise contemplated that there is a space therebetween.

In this articulated configuration, divisible shipping platform 450 may accept a load for transportation, storage and handling; has at least two tine entry sites, depending on the configuration of the pylons and the structure of the first and second side panels; and may be divided in much the same way as described above. Indeed, inasmuch as the first bottom and second bottom wing panels are not connected, the top panel needs only be severed along frangibility line 480 to divide the divisible shipping platform into two independent shipping platform units. Of course, any further divisions require severing the portions of frangibility line 482 in the top panel and corresponding side panels and bottom wing panels, if the corresponding side panels and bottom wing panels are not already severed before articulation. Indeed, it is preferred that at least the side panels are severed before articulation inasmuch as the upward force severing the top panel and bottom wing panel frangibility lines is substantially perpendicular to the plane of both sets of frangibility lines, but is substantially planar to the side panel frangibility lines.

Finally, although it is preferred that the divisible shipping platforms contemplated herein are constructed of a substantially recyclable material such as paperboard or corrugated paperboard, other materials such as plastic or wood may be integrated into the structure of the shipping platform. For instance, plastic or other pylons may be used in combination with paperboard or corrugated paperboard platform members and bottom panel members. Likewise, a plastic or other bottom panel member may be used in combination with a substantially paperboard platform member, to, for instance, increase the ability of the shipping platform apparatus to withstand exposure to water or substantial humidity.

The foregoing description and drawings merely explain and illustrate the invention and the invention is not limited thereto except insofar as the appended claims are so limited, as those skilled in art who have the disclosure before them will be able to make modifications and variations therein without departing from the scope of the invention.

What is claimed is:

1. A divisible shipping platform apparatus for supporting and transporting loads by conventional tined material handling devices, which apparatus can be operably divided into multiple, independent shipping platform units for supporting and transporting loads, said divisible shipping platform apparatus comprising:

a substantially flat, planar load-bearing platform member for supporting said load, said platform member having a top surface and a bottom surface opposite said top surface, wherein said load is capable of resting upon said top surface during the storage and transporting of said load;

a substantially flat planar bottom panel member positioned substantially parallel to, and distally spaced below said platform member, for supporting and bearing the weight of both said platform member and said load, said bottom panel member having a top surface and a bottom surface opposite said top surface;

a plurality of pylons operably positioned between said platform member and said bottom panel member so as to facilitate the insertion, maintenance and removal of one or more tines of said conventional tined material handling devices therebetween, and to further maximize the supportable strength of said apparatus while providing balance, stability and support to said divisible shipping platform apparatus during use thereof, each of said pylons having a top end and a bottom end opposite said top end, and an outer surface, said top end of each of said pylons being operably secured to said bottom surface of said platform member, and said bottom end of each of said pylons being operably secured to said top surface of said bottom panel member;

at least one frangibility line operably positioned across at least a portion of at least one of the platform member and the bottom panel member so as to enable severing of at least said portion of one of said platform member and said bottom panel member along said at least one frangibility line to, in turn, facilitate reduction in size of the overall shipping platform apparatus into multiple, independent shipping platform units of smaller size for the subsequent handling, supporting and transporting of loads borne thereby.

2. The invention according to claim 1 wherein said at least one frangibility line positioned in at least one of said platform member and said bottom panel member spans the substantial length of at least one of the longitudinal and transverse dimensions of at least one of the platform member and the bottom panel member so as to facilitate reduction in size of the overall shipping platform apparatus into multiple, independent shipping platform units of smaller size.

3. The invention according to claim 1 wherein said at least one frangibility line is positioned in at least a portion of both said platform member and said bottom panel member so as to facilitate reduction in size of the overall shipping platform apparatus into multiple, independent shipping platform units of smaller size.

4. The invention according to claim 3 wherein said frangibility lines positioned in at least a portion of both the platform member and the bottom panel member are in substantial alignment.

5. The invention according to claim 3 wherein said frangibility lines positioned in at least a portion of both the platform member and the bottom panel member are at least partially misaligned so as to preclude inadvertent separation of said divisible shipping platform apparatus into multiple components.

6. The invention according to claim 1 wherein said at least one frangibility line comprises a series of perforations, each perforation having a predetermined configuration and length so as to impart a frangibility threshold to said at least one frangibility line.

7. The invention according to claim 6 wherein said frangibility line perforations are positioned in at least a portion of both said platform member and said bottom panel member.

8. The invention according to claim 7 wherein said series of perforations in said platform member being different in at least one of configuration and length from said series of perforations in said bottom panel member, so as to impart a different frangibility threshold on said at least one frangibility line in said platform member than the frangibility threshold associated with said at least one frangibility line in said bottom panel member.

9. The invention according to claim 7 wherein said frangibility threshold is lower in said bottom panel member than in said top platform member to facilitate division of said divisible shipping platform apparatus into multiple independent shipping platform units.

10. The invention according to claim 1 wherein at least a portion of said at least one frangibility line comprises a tear strip integrally formed in at least one of said platform member and said bottom panel member.

11. The invention according to claim 1 wherein said bottom panel member includes at least one aperture, such that said at least one aperture facilitates effective cooperation of said divisible shipping platform apparatus with said tined material handling device by allowing at least a portion of said tined material handling device to be positioned between said platform member and said bottom panel member during the raising, relocation, and lowering of said divisible shipping platform apparatus and, in turn, said load.

12. The invention according to claim 11 wherein said at least one aperture takes the form of at least one shape from the group consisting of circles, squares, rectangles, triangles, ovals, or polygons.

13. The invention according to claim 11 wherein said bottom panel member comprises four divisible regions, each of said divisible regions including an aperture to facilitate effective cooperation of said divisible shipping platform apparatus with said tined material handling device.

14. The invention according to claim 1 wherein said bottom panel member comprises at least one perforated region, said at least one perforated region defining at least one aperture region having a top surface operably positioned co-planar to said top surface of said bottom panel member, and a bottom surface operably positioned co-planar to said bottom surface of said bottom panel member, thereby adding overall structural rigidity to said bottom panel member prior to detachment and removal of said at least one perforated region from said bottom panel member, said at least one perforated region detaching from said bottom panel member upon application of a loading force to said at least one perforated region by said conventional material handling device so as to expose at least one aperture region defined by said at least one perforated region.

15. The invention according to claim 14 wherein said bottom panel member comprises four divisible regions, each of said divisible regions including a perforated region to facilitate effective cooperation of said divisible shipping platform apparatus with said tined material handling device.

16. The invention according to claim 1 wherein said pylons have a substantially elongated configuration.

17. The invention according to claim 1 wherein said pylons are further tubular in shape to include an interior region having an inner surface.

18. The invention according to claim 17 wherein said pylons have a substantially elongated configuration.

19. The invention according to claim 1 wherein said pylons are constructed from multiple layers of substantially paperboard material.

20. The invention according to claim 1 wherein said pylons are constructed from multiple substantially concentric layers of paperboard material.

21. The invention according to claim 1 wherein said pylons are operably positioned between said platform member and said bottom panel member to facilitate the insertion, maintenance and removal of the tines of said conventional tined material handling devices into and from said divisible shipping platform apparatus before division of said divisible shipping platform apparatus into multiple independent shipping platform units, and wherein said pylon positioning also facilitates insertion, maintenance and removal of said tines into and from said independent shipping platform units after division of said divisible shipping platform.

22. The invention according to claim 1 wherein said pylons are operably secured to said bottom surface of said platform member and said top surface of said bottom panel member by an adhesive.

23. The invention according to claim 1 further comprising:

at least one pylon sleeve for operably housing said pylons, wherein said pylon sleeve includes a top sleeve member having a top surface, a bottom surface, and two opposing side edges;

a bottom sleeve member having a top surface, a bottom surface, two opposing side edges, and an opening;

said top end of at least two pylons being operably secured to said bottom surface of said top sleeve member, and said bottom end of each of said at least two pylons being operably secured to said top surface of said bottom sleeve member, said top surface of said top sleeve member being operably secured to said bottom surface of said platform member, and said bottom surface of said bottom sleeve member being operably secured to said top surface of said bottom panel member, so as to facilitate the insertion, maintenance and removal of the tines of said conventional tined material handling devices therebetween, and to further maximize the supportable strength of said apparatus while providing balance, stability and support to said shipping platform apparatus during use thereof.

24. The invention according to claim 23 wherein said at least one pylon sleeve further comprises:

at least two top sleeve member side panels, said top sleeve member side panels foldably emanating from said top sleeve member opposing side edges;

at least two bottom sleeve member side panels, said bottom sleeve member side panel foldably emanating from said bottom sleeve member opposing side edges, said top sleeve member side panels substantially overlaying and being secured to at least a portion of said outside surface of said pylons, and said bottom sleeve member side panels substantially overlaying and being secured to at least a portion of said top sleeve member side panels.

25. The invention according to claim 23 wherein said shipping platform apparatus further comprises at least two substantially equally sized divisible regions, each of said divisible regions having said pylon sleeve and said housed pylons positioned between said platform member and said bottom panel member.

26. The invention according to claim 23 wherein said at least one pylon sleeve comprises a substantially paperboard material.

27. The invention according to claim 23 wherein said bottom sleeve member opening substantially aligns with one of said apertures formed in said bottom panel.

28. The invention according to claim 1 wherein said platform member comprises at least one layer of corrugated paperboard material.

29. The invention according to claim 1 wherein said bottom panel member comprises at least one layer of corrugated paperboard material.

30. The invention according to claim 1 wherein at least one of said platform member and said bottom panel member comprise two or more layers of corrugated paperboard material, each layer having a direction of corrugation, in which the direction of corrugation of at least one of said platform member layers is substantially transverse to the direction of corrugation of at least one of said bottom panels layers to impart increased multi-directional strength to said divisible shipping platform apparatus.

31. The invention according to claim 1 wherein said divisible shipping platform is divisible into at least two independent shipping platform units.

32. The invention according to claim 31 wherein said divisible shipping platform is divisible into four independent shipping platform units.

33. The invention according to claim 1 wherein said platform member further comprises:

at least one pair of opposing edges and a pair of side panels foldably emanating from said at least one pair of opposing platform member edges.

34. The invention according to claim 1 wherein said bottom panel member further comprises:

at least one pair of opposing edges and a pair of side panels foldably emanating from said at least one pair of opposing bottom panel member edges.

35. A divisible shipping platform apparatus for supporting and transporting loads by conventional tined material handling devices, which apparatus can be separated into multiple, independent shipping platform units for supporting and transporting loads, said divisible shipping platform apparatus comprising:

a substantially flat planar load-bearing platform member for supporting said load, said platform member formed of a substantially paper material and having a top surface and a bottom surface opposite said top surface, wherein said load is capable of resting upon said top surface during the storage and transporting of said load;

a plurality of pylons operably attached to said platform member, each of said pylons having a top end and a bottom end opposite said top end, and an outer surface, said top end of each of said pylons being operably secured to said bottom surface of said platform member, and said bottom end of each of said pylons being positionable on any shipping platform apparatus support surface, so as to facilitate the insertion, maintenance and removal of the tines of said conventional tined material handling devices between the platform member and the shipping platform apparatus support surface, and to further maximize the supportable strength of said apparatus while providing balance, stability and support to said divisible shipping platform apparatus during use thereof;

at least one frangibility line operably positioned across at least a portion of the platform member so as to enable severing of said portion of said platform member along said at least one frangibility line to, in turn, facilitate reduction in size of the overall shipping platform apparatus into multiple, independent shipping platform units of smaller size for subsequent handling of said loads.

36. The invention according to claim 35 wherein said at least one frangibility line spans the substantial length of at least one of the longitudinal and transverse dimensions of the platform member such that said divisible shipping platform apparatus may be divided into at least two independent shipping platform units.

37. The invention according to claim 35 further comprising:

a bottom panel member, wherein said bottom panel member comprises at least two pre-separated bottom panels, wherein said bottom panels are attached to said bottom ends of said pylons such that said at least two bottom panels are substantially planar so as to allow the shipping platform apparatus to rest on a platform support surface.

38. The invention according to claim 35 wherein said divisible shipping platform is divisible into at least two independent shipping platform units.

39. The invention according to claim 38 wherein said divisible shipping platform is divisible into four independent shipping platform units.

40. The invention according to claim 35 further comprising:

at least one pylon sleeve for operably housing said pylons, wherein said pylon sleeve includes a top sleeve member having a top surface, a bottom surface, and two opposing side edges;

a bottom sleeve member having a top surface, a bottom surface, two opposing side edges, and an opening;

at least two top sleeve member side panels, said top sleeve member side panels foldably emanating from said top sleeve member opposing side edges;

at least two bottom sleeve member side panels, said bottom sleeve member side panel foldably emanating from said bottom sleeve member opposing side edges, said top sleeve member side panels substantially overlaying and being secured to at least a portion of said outside surface of said pylons, and said bottom sleeve member side panels substantially overlaying and being secured to at least a portion of said top sleeve member side panels, said top end of at least two pylons being operably secured to said bottom surface of said top sleeve member, and said bottom end of each of said at least two pylons being operably secured to said top surface of said bottom sleeve member, said top surface of said top sleeve member being operably secured to said bottom surface of said platform member, so as to facilitate the insertion, maintenance and removal of the tines of said conventional tined material handling devices therebetween, and to further maximize the supportable strength of said apparatus while providing balance, stability and support to said shipping platform apparatus during use thereof.

41. A divisible shipping platform apparatus for supporting and transporting loads by conventional tined material handling devices, which apparatus can be operably divided into multiple, independent shipping platform units for supporting and transporting loads, said divisible shipping platform apparatus comprising a substantially unitary paperboard blank including:

a top panel having a top surface, a bottom surface, a first edge, a second edge, and at least one frangibility line operably positioned across at least a portion of said top panel so as to enable severing of said portion of said top panel along said at least one frangibility line to, in turn, facilitate reduction in size of the overall shipping platform apparatus into multiple, independent shipping platform units for subsequent handling of loads;

a first side panel, having a first side edge, foldably emanating from the first edge of said top panel, said first side panel positioned substantially perpendicular to said top panel;

a second side panel, having a first side edge, foldably emanating from the second edge of said top panel, said second side panel positioned substantially perpendicular to said top panel;

a first bottom wing panel foldably emanating from the first side edge of said first side panel, said first bottom wing panel positioned substantially parallel to, and distally spaced below said top panel, said first bottom wing panel having a top surface and a bottom surface opposite said top surface;

a second bottom wing panel foldably emanating from the first side edge of said second side panel, said second bottom wing panel positioned substantially parallel to, and distally spaced below said top panel, said second bottom wing panel having a top surface and a bottom surface opposite said top surface, said bottom surface being substantially planar with said bottom surface of said first bottom wing panel, said first and second bottom wing panels being substantially co-planar to one another in an articulated orientation; and a plurality of pylons operably positioned between said top panel and said first bottom and said second bottom wing panels so as to facilitate the insertion, maintenance and removal of the tines of said conventional tined material handling devices therebetween, and to further maximize the supportable strength of said apparatus while providing balance, stability and support to said divisible shipping platform apparatus during use thereof, each of said pylons having a top end and a bottom end opposite said top end, and an outer surface, said top end of each of said pylons being operably secured to said bottom surface of said top panel, and said bottom end of each of said pylons being operably secured to said top surface of one of said first bottom wing panel and said second bottom wing panel.

42. The invention according to claim 41 wherein at least one of said first and second side panels further comprises at least one opening to facilitate insertion and removal of tines from said material handling equipment.

43. The invention according to claim 42 wherein said first and second side panel both include at least two openings to facilitate insertion and removal of tines from said material handling equipment.

44. The invention according to claim 41 wherein at least one of said first bottom wing panel and said second bottom wing panel further include at least one aperture, such that said at least one aperture facilitates effective cooperation of said divisible shipping platform apparatus with said tined material handling device by allowing said tined material handling device to be positioned between said top panel and at least one of said first bottom wing panel and said second bottom wing panel during the raising, relocation, and lowering of said divisible shipping platform apparatus and, in turn, said load.

45. The invention according to claim 41 wherein said at least one top panel frangibility line spans the substantial length of both the longitudinal and transverse dimensions of the top panel, thus defining top panel divisible regions.

46. The invention according to claim 45 wherein at least one of said first and second side panels and said first bottom and second bottom wing panels further include a frangibility line running substantially transverse to said top panel longitudinal frangibility line.

47. The invention according to claim 46 wherein said first and second side panels and said first bottom and second bottom wing panels all include a frangibility line that is substantially aligned with the top panel transverse frangibility line.

48. The invention according to claim 47 wherein said first and second side panel frangibility lines are completely severed prior to articulation of said substantially paperboard blank.

49. The invention according to claim 47 wherein said first bottom wing panel and said second bottom wing panel frangibility lines are completely severed prior to articulation of said substantially paperboard blank.

50. The invention according to claim 41 wherein said divisible shipping platform is divisible into at least two independent shipping platform units.

51. The invention according to claim 50 wherein said divisible shipping platform is divisible into four independent shipping platform units.

* * * * *